US007922491B2

(12) United States Patent
Jones et al.

(10) Patent No.: US 7,922,491 B2
(45) Date of Patent: Apr. 12, 2011

(54) METHODS AND APPARATUS TO PROVIDE TRAINING AGAINST IMPROVISED EXPLOSIVE DEVICES

(75) Inventors: Giles D. Jones, Chino Hills, CA (US); Lee L. Ourn, Loma Linda, CA (US); Saman Jannati, Diamond Bar, CA (US); Quang K. Ha, El Monte, CA (US)

(73) Assignee: Raytheon Company, Waltham, MA (US)

( * ) Notice: Subject to any disclaimer, the term of this patent is extended or adjusted under 35 U.S.C. 154(b) by 525 days.

(21) Appl. No.: 11/535,969

(22) Filed: Sep. 27, 2006

(65) Prior Publication Data

US 2007/0166667 A1 Jul. 19, 2007

Related U.S. Application Data

(60) Provisional application No. 60/721,347, filed on Sep. 28, 2005.

(51) Int. Cl.
*F41A 33/00* (2006.01)

(52) U.S. Cl. ..... 434/11; 434/15; 434/19; 434/21; 434/22; 89/1.1

(58) Field of Classification Search ..... 434/19–23
See application file for complete search history.

(56) References Cited

U.S. PATENT DOCUMENTS 2,674,923 A * 4/1954 Brandt ..... 434/12
3,698,790 A * 10/1972 Berry ..... 359/555
4,014,262 A 3/1977 Betts
4,024,392 A * 5/1977 Teppo et al. ..... 250/216
4,062,634 A * 12/1977 Rando et al. ..... 356/248
4,717,822 A * 1/1988 Byren ..... 250/236
4,934,937 A * 6/1990 Judd ..... 434/21
5,235,127 A 8/1993 Findley
5,326,268 A 7/1994 Campagnuolo
5,474,452 A 12/1995 Campagnuolo
5,481,979 A * 1/1996 Walder ..... 102/498

(Continued)

OTHER PUBLICATIONS

DefenseLINK News: Arrival Sets Tone for Civic Leader's Fort Bliss Visit, United States Department of Defense, Oct. 17, 2005, 4 pages.

(Continued)

*Primary Examiner* — Xuan M Thai
*Assistant Examiner* — Robert J Utama
(74) *Attorney, Agent, or Firm* — Daly, Crowley, Mofford & Durkee, LLP

(57) ABSTRACT

In one embodiment, an explosive device (IED) simulator usable with a laser detector is provided, the IED simulator comprising a laser transmitter and a first switch. The laser transmitter is capable of directing a laser signal to the laser detector, the laser signal comprising information readable by the laser detector, wherein the laser signal is designed to simulate at least a first type of explosion of an IED. The first switch is operably coupled to the laser transmitter, the first switch permitting a user to trigger the laser signal from the laser transmitter. The first type of explosion that is simulated can comprise at least one type selected from the group consisting of an indoor IED explosion, an outdoor IED explosion, a long range IED explosion, an IED explosion of 2 m to 5 m away from a target, an IED explosion of up to 600 m from a target, and an IED explosion having a predetermined kill pattern. Advantageously, the laser transmitter is constructed and arranged to generate a laser signal encoded with a MILES code.

25 Claims, 16 Drawing Sheets

U.S. PATENT DOCUMENTS

| | | | | |
|---|---|---|---|---|
| 5,777,768 | A * | 7/1998 | Korevaar | 398/129 |
| 5,788,500 | A * | 8/1998 | Gerber | 434/22 |
| 5,823,779 | A * | 10/1998 | Muehle et al. | 434/21 |
| 6,065,404 | A * | 5/2000 | Ripingill et al. | 102/498 |
| 6,147,748 | A * | 11/2000 | Hughes | 356/4.09 |
| 6,254,394 | B1 * | 7/2001 | Draper et al. | 434/11 |
| 6,386,879 | B1 | 5/2002 | Varshneya et al. | |
| 6,422,145 | B1 * | 7/2002 | Gavrilovic et al. | 102/200 |
| 6,450,817 | B1 | 9/2002 | Deinlein | |
| 6,579,097 | B1 | 6/2003 | Sampson et al. | |
| 6,599,127 | B1 | 7/2003 | Hopmeier et al. | |
| 6,606,066 | B1 * | 8/2003 | Fawcett et al. | 343/725 |
| 6,616,452 | B2 | 9/2003 | Clark et al. | |
| 6,763,596 | B1 * | 7/2004 | Puri et al. | 33/286 |
| 6,814,667 | B2 | 11/2004 | Jeffway, Jr. et al. | |
| 6,969,176 | B2 * | 11/2005 | Pohle | 359/856 |
| 7,001,182 | B2 * | 2/2006 | Lazecki et al. | 434/11 |
| 2002/0050067 | A1 * | 5/2002 | Duska et al. | 33/286 |
| 2003/0027103 | A1 * | 2/2003 | Preston et al. | 434/11 |
| 2004/0096806 | A1 | 5/2004 | Davidsson et al. | |
| 2005/0179890 | A1 * | 8/2005 | Cramer et al. | 356/138 |
| 2006/0228677 | A1 * | 10/2006 | Stennert et al. | 434/11 |
| 2007/0075182 | A1 * | 4/2007 | Fetterly | 244/3.16 |
| 2008/0002176 | A1 * | 1/2008 | Krasutsky | 356/4.01 |

OTHER PUBLICATIONS

M-72 Light Anti-tank Weapon (LAW), FAS Military Analysis Network, Dec. 20, 2005, 4 pages.
OSI Defense Systems, Our Products, Training Systems, Oct. 17, 2005, 7 pages.
Titan Dynamics Systems, Inc., Training the way you fight!, Rocket Propelled Grenade System (RPGS),Oct. 17, 2005, 1 page.
Simulation Projects, Shoulder Launched Munitions (SLM), 4 pages, Jul. 27, 2006, www.unitech1.com/solutions__sim__p2.htm.
PEO STRI, One Team. Fight. Training Future, PEOSTRI Program Guide, www.military-training-technology.com/PDF/2006__PEO__STRI.PDF, 16 pages.
Improvised explosive device, Wikipedla, Jul. 2006, http://en.wikipedla.org/wikl/Improvised__explosive__device.
Multiple Integrated Laser Engagement System Shoulder Launched Munitions (MILES SLM), Jul. 2006, www.peostri.army.mil/PRODUCTS/MILES__SLM/, 1 page.
PEO STRI Awards $18 Million Contract for the Multiple Integrated Laser Engagement Simulation (MILES) Shoulder Launched Munitions, Jul. 2006, www.peostri.army.mil/PAO/pressrelease/MILES__SLM.jsp, 1 page.
Military Training Technology, Online Edition, Replicating a Grim Reality, www.military-training.com/print__article.cfm?DocID=664, Jul. 2006, 4 pages.
DefenseLINK News: Arrival Sets Tone for Civic Leader's Fort Bliss Visit, United States Department of Defense, Oct. 17, 2005, 4 pages.
M-72 Light Anti-tank Weapon (LAW), FAS military Analysis Network, Dec. 20, 2005, 4 pages.
OSI Defense Systems, Our Products, Training Systems, Oct. 17, 2005, 7 pages.
Titan Dynamics Systems, Inc., Training the way you fight!, Rocket Propelled Grenade System (RPGS), Oct. 17, 2005, 1 page.
Simulation Projects, Shoulder Launched Munitions (SLM), 4 pages, Jul. 27, 2006, www.unitech1.com/solutions—sim__p2.htm.
PEO STRI, One Team. Fight. Training Future, PEOSTRI Program Guide, www.military-training-technology.com/PDF/2006__PEO__STRI.PDF, 16 pages.
Improvised explosive device, Wikipedia, Jul. 2006, 4 pages. http://en.wikipedia.org/wiki/Improvised__explosive__device.
Multiple Integrated Laser Engagement System Shoulder Launched Munitions (MILES SLM), Jul. 2006, www.peostri.army.mil/PRODUCTS/MILES__SLM/, 1 page.
PEO STRI Awards $18 Million Contract for the Multiple Integrated Laser Engagement Simulation (MILES) Shoulder Launched Munitions, Jul. 2006, www.peostri.army.mil/PAO/pressrelease/MILES__SLM.jsp, 1 page.
Military Training Technology, Online Edition, Replicating a Grim Reality, www.military-training.com/print__article.cfm?DocID=664, Jul. 2006, 4 pages.
File downloaded for U.S. Appl. No. 11/182,495, filed Jul. 15, 2005, file through Jun. 26, 2009, 169 pages.
File downloaded for U.S. Appl. No. 12/356,156, filed Jan. 20, 2009, file through Jun. 26, 2009, 58 pages.
File downloaded for U.S. Appl. No. 12/356,569, filed Jan. 21, 2009, file through Jul. 9, 2009, 341 pages.
Notice of Allowance and Fee(s) Due, date mailed Sep. 29, 2010, U.S. Appl. No. 11/330,902, filed Jan. 12, 2006, 7 pages.
File downloaded for U.S. Appl. No. 11/330,902, filed Jan. 12, 2006, file through Oct. 12, 2010, Part 1, 300 pages.
File downloaded for U.S. Appl. No. 11/330,902, filed Jan. 12, 2006, file through Oct. 12, 2010, Part 2, 279 pages.

* cited by examiner

TRANSMITTER ASSEMBLY

LASER TRANSMITTER ORIENTATION

MULTI-LASER ASSEMBLY

BALL HOUSING-LOWER

4 TRANSMITTER CONFIGURATION

METHODS AND APPARATUS TO PROVIDE TRAINING AGAINST IMPROVISED EXPLOSIVE DEVICES

CROSS-REFERENCE TO RELATED APPLICATIONS

This application claims the priority of U.S. Provisional Application No. 60/721,347 entitled "Methods and Apparatus for Multiple Integrated Laser Engagement System for Improvised Explosive Device Training," filed Sep. 28, 2005, the contents of which are incorporated herein by reference in their entirety. This patent application is also related to commonly assigned and co-pending U.S. patent application Ser. No. 11/330,902, entitled "Simulation Devices And Systems For Rocket Propelled Grenades And Other Weapons," filed Jan. 12, 2006, the contents of which are incorporated herein by reference in their entirety.

FIELD OF THE INVENTION

Embodiments of the invention generally relate to devices, systems, and methods for simulating the operation and effect of various weapons, especially explosive weapons, during military training exercises. More particularly, the invention relates to devices, systems and methods for simulating the operation and effect of weapons such as Improvised Explosive Devices (IEDs) in a laser-based battle simulation environment.

BACKGROUND OF THE INVENTION

At present, in live battlefield military operations in areas such as the Middle East, opposing forces using weapons such as the Improvised Explosive Device (IED) are presenting a significant threat to U.S. military forces stationed there. Estimates by U.S. military officials and others indicate that IEDs are responsible for anywhere from 33% to 80% of the U.S. casualties sustained in Operation Iraqi Freedom.

An IED is a device that is made or used in an improvised manner and can use destructive, noxious, lethal, incendiary, pyrotechnic, or explosive substances to kill, destroy, incapacitate, distract, or harass both people and things. IEDs generally include an explosive charge, a detonator, and an initiation system (which can be electronic or mechanical), put together in such a way that the IED is rigged to explode. Many different devices are used to detonate an IED, often remotely, including items such as mobile phones, doorbells, motion sensors, and other devices capable of generating a signal that can be used as a trigger signal. IEDs are often hidden and/or disguised in order to inflict maximum damage; IEDs can be disguised as anything and hidden virtually anywhere. Because the IED is so simple to use, effective, damaging, and widely available, hostile forces around the world, including many terrorists, insurgents, and guerrilla armies hostile to the U.S. and its allies, have made it one of their key weapons.

Common locations for placing IEDs include locations where they can explode underneath or to the side of a vehicle, such as in or near road signs, mounted on trees, hidden inside bushes, hidden inside boxes or other items placed near a road, and even mounted in or on other vehicles parked near a road or riding on a road. One of the greatest threats IEDs place is to convoys (e.g., of vehicles and/or troops), but IEDs also have been used in enclosed areas.

One way that the U.S. military trains its forces to deal with various military combat situations is using laser-based combat simulation systems. Such laser-based systems have been developed to simulate military combat situations without actually having to fire live ammunition. These systems use relatively low power lasers and matched detectors for indicating when a "hit" has occurred. One such system is the Multiple Integrated Laser Engagement Systems, referred to as the MILES system. Military forces in the U.S. and around the world have found MILES to be an important tool to help soldiers and others learn combat survival skills and evaluate battle outcomes, and MILES training has been proven to dramatically increase the combat readiness and fighting effectiveness of military forces.

An illustrative implementation of MILES uses so-called eye-safe "laser bullets," combined with the use of laser sensitive detectors, to simulate battlefield situations. Each individual and vehicle in the training exercise has a detection system to sense hits and perform casualty assessment. For example, as part of an exemplary MILES event, some soldiers are equipped with one or more laser detectors (e.g., an optical detector) capable of receiving a coded laser signal or pulse that has been fired, and these laser detectors can be attached to the soldier himself to a vehicle the solder is riding on or in, or to any other location proximate to a target of interest. Other soldiers are equipped with laser transmitters capable of "shooting" coded laser signals and/or pulses of infrared energy. These laser transmitters can be readily attached to and detached from any location, person, or thing (e.g., vehicle mounted weapons, hand carried weapons, vehicles, tanks, etc.). In some implementations, one or more of the coded laser signals and/or pulses are modulated to indicate the type of weapon that is the source of the laser beam; and a soldier identification number may also be included in the transmitted signal.

When the laser sensitive detectors receive the coded laser signal/pulse(s), one or more MILES decoders determine whether the target was hit and, if so, whether the "laser bullet" was accurate enough to cause damage (e.g., a casualty). This determination can be made in various ways, such as by whether the coded signals/pulses exceed a threshold, whether the coded signals/pulses actually hit its intended target, and the like. In some implementations, the target (and/or the shooter) can be made aware almost instantly of the accuracy of a simulated shot, such as by audible alarms, visible displays, pyrotechnics, and the like, where these indicators can designate a hit or near miss and also help to provide realism for the soldiers.

In more recent implementations of MILES, all action by shooters and targets (deemed "players") is recorded during a simulated event, so that a so-called After Action Review (AAR) can occur later, to review the effectiveness of the weapons and/or of the defenses against them. For example, one implementation of AAR allows commanders to process, format and view engagement data collected during an exercise, for review after the exercise. In addition, exercise data can be archived for future use, such as to provide additional training for military forces.

The U.S. military has great interest in training its personnel to deal with military combat situations in which IEDs may be used. However, at present, the ability to train against IEDs is limited. Existing IED training devices, available from Cubic Corporation of San Diego, Calif. and Unitech Corporation of Hampton, Va., can provide audible and/or visible simulation of an IED explosion, but neither can simulate a large explosion pattern, nor can either be used with the MILES training system.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

In one embodiment, the invention provides an IED simulation device usable with a laser detector, the IED simulation device comprising a laser transmitter, a controller, and a switch. The laser transmitter is capable of directing a laser signal to the laser detector in response to a signal from a detonator, the laser signal comprising information readable by the laser detector, where the laser signal simulates the explosion of an IED to a laser detector used within a MILES system. The switch permits a user to trigger a laser signal from the laser transmitter. The controller is in operable communication with the laser transmitter and the detonator, and the controller is operable to respond to triggering of the switch and to simulate a predetermined pattern of the explosion of an IED by directing the laser transmitter to generate and transmit a particular type of laser signal to simulate the desired IED explosive effect.

The laser signal can comprise a pulse of laser energy. The IED simulation device can further comprise an anti-tank weapons effect systems simulator (ATWESS) in operable communication with the controller, the ATWESS generating an indicator replicating a physical effect that occurs when an IED is launched. When the detonator is triggered, the controller can command the ATWESS to generate the indicator replicating the physical effect. For example, the indicator can comprise at least one physical effect selected from the group consisting of a noise, a visual effect, a gaseous effect, muzzle flash, smoke, an audible effect, and a blast sound.

The IED simulation device can further comprise a display in communication with the controller, wherein the display is constructed and arranged to display information related to operation of the IED to an operator of the IED. For example, the displayed information can comprise at least one piece of information selected from the group consisting of round count, player identification number, laser power level, rounds remaining, weapon type, and battery level. In addition, the IED simulation device can include indicators capable of indicating to a user that a laser signal has been transmitted and/or capable of enabling alignment of the laser transmitter.

In one embodiment, the laser transmitter can transmit a laser signal encoded with a MILES code, such as a code recognizable by a MILES-type detector. In one embodiment, the controller can perform additional operations, such as one or more of: tracking number of rounds fired; tracking a player identification number, tracking a power level of a laser signal emitted by the laser transmitter; tracking a battery level; generating a programmable hit and near miss word, adjusting a power level of the laser signal emitted by the laser transmitter; adjusting an alignment of the laser signal emitted by the laser transmitter; generating a signal to control the laser signal where the laser signal further comprises a MILES code; tracking MILES code related information in a laser signal that comprises a MILES code; receiving an instruction from an external system via a USB port; providing data to an external system via a USB port; providing information to a display; providing reverse voltage protection; responding to a controller key; responding to a push to read switch; responding to a magnetic switch; responding to a trigger switch; and responding to a safety switch.

In one embodiment, an explosive device (IED) simulator usable with a laser detector is provided, the IED simulator comprising a laser transmitter and a first switch. The laser transmitter is capable of directing a laser signal to the laser detector, the laser signal comprising information readable by the laser detector, wherein the laser signal is designed to simulate at least a first type of explosion of an IED. The first switch is operably coupled to the laser transmitter, the first switch permitting a user to trigger the laser signal from the laser transmitter. The first type of explosion that is simulated can comprise at least one type selected from the group consisting of an indoor IED explosion, an outdoor IED explosion, a long range IED explosion, an IED explosion of 2 m to 5 m away from a target, an IED explosion of up to 600 m from a target, and an IED explosion having a predetermined kill pattern. For example, the predetermined kill pattern can comprise a pattern of laser energy that is approximately 67 m long by 31 m wide by 4 m high.

In a further embodiment, the IED simulator further comprises a physical effect simulator in communication with the switch, the physical effect simulator responsive to the switch to produce at least one physical effect that simulates the explosion of an IED. For example, the physical effect can comprise at least one effect selected from the group consisting of a noise, a visual effect, a gaseous effect, muzzle flash, smoke, an audible effect, a blast sound, and a pyrotechnic effect, and the physical effect simulator can comprise at least one of an anti-tank weapons effect systems simulator (ATWESS) and a pyrotechnic device, such as an M80.

In still another embodiment, the IED simulator further comprises a controller in operable communication with the laser transmitter and the first switch, the controller operable to respond to triggering of the first switch, and direct the laser transmitter to generate and transmit the laser signal simulating the explosion of an IED, wherein the controller selects a type of an IED explosion to simulate based on the one or more predetermined conditions For example, the predetermined condition can comprise at least one condition selected from the group consisting of the setting of a second switch, wherein the second switch selects the type of IED explosion to be generated, and a control signal received at the controller, the control signal directing the controller to simulate a type of IED explosion.

The control signal can be provided by at least one of a computing device; a remote trigger device constructed and arranged to permit a user to remotely trigger the laser transmitter; a receiver in operable communication with a third switch, the third switch directing the controller to simulate a type of IED explosion; and a receiver in operable communication with a wireless remote trigger device, the receiver capable of receiving a radio frequency (RF) signal from the wireless remote trigger device, the wireless remote trigger device permitting a user to remotely trigger the laser transmitter.

In still another embodiment, the IED simulator further comprises a display in communication with the controller, wherein the display is constructed and arranged to display information related to operation of the IED simulator to an operator of the IED simulator. The IED simulator, in another embodiment, further comprises a first indicator capable of indicating to a user that a laser signal has been transmitted and/or a second indicator capable of enabling alignment of the laser transmitter.

In at least some embodiments, the laser transmitter is constructed and arranged to generate a laser signal encoded with a MILES code. In some embodiments, the laser transmitter is constructed and arranged to generate an alignment laser signal. In some embodiments, the laser signal is capable of being read by a laser detector used with the MILES system.

In a further aspect, the invention provides a method for simulating the explosion of an improvised explosive device (IED). A laser signal is generated, where the laser signal is readable by a laser detector and simulates at least a first type of explosion of an IED. A user accessible control is provided, the user accessible control enabling a user to cause the laser signal to be generated. The laser signal can be constructed and arranged to simulate at least one type of IED explosion selected from the group consisting of an indoor IED explosion; an outdoor IED explosion; a long range IED explosion; an IED explosion of 2 m to 5 m away from a target; an IED explosion of up to 600 m from a target; and an IED explosion having a predetermined kill pattern.

In a further embodiment, a physical effect simulator is provided, the physical effect simulator being in operable communication with the user accessible control and being capable of producing at least one physical effect that simulates the explosion of an IED. In still another embodiment, information related to operation of the IED simulator is displayed to a user. In another embodiment, the laser signal is encoded with a MILES code that is readable by a MILES laser detector.

In still another aspect, the invention provides a system usable with a detector responsive to a laser signal for simulating the operation of an improvised explosive device (IED), the system comprising means for enabling a user to trigger a simulated explosion of an IED; and means for directing a laser signal to the detector in response to the trigger from the user, the laser signal having a pattern that simulates a first type of IED explosion. The system, in a further embodiment, can comprise means for directing a laser signal to the detector in response to the trigger from the user, the laser signal having a pattern that simulates at least one event selected from the group consisting of an indoor IED explosion, an outdoor IED explosion, a long range IED explosion, an IED explosion of 2 m to 5 m away from a target, an IED explosion of up to 600 m from a target, and an IED explosion having a predetermined kill pattern.

The system can further comprise means for generating a physical indicator simulating the IED explosion. The system can further comprise means for generating at least one of the physical effects selected from the group consisting of: a noise, a visual effect, a gaseous effect, muzzle flash, smoke, an audible effect, a blast sound, and a pyrotechnic effect. In addition, the system can further comprise means for providing a laser signal encoded with a MILES code that is readable by a MILES laser detector.

Details relating to this and other embodiments of the invention are described more fully herein.

BRIEF DESCRIPTION OF THE DRAWINGS

The advantages and aspects of the present invention will be more fully understood in conjunction with the following detailed description and accompanying drawings, wherein.

In the drawings, like reference numbers indicate like elements. The drawings are not to scale, emphasis instead being on illustrating the principles of the invention.

DETAILED DESCRIPTION

Figure 1:
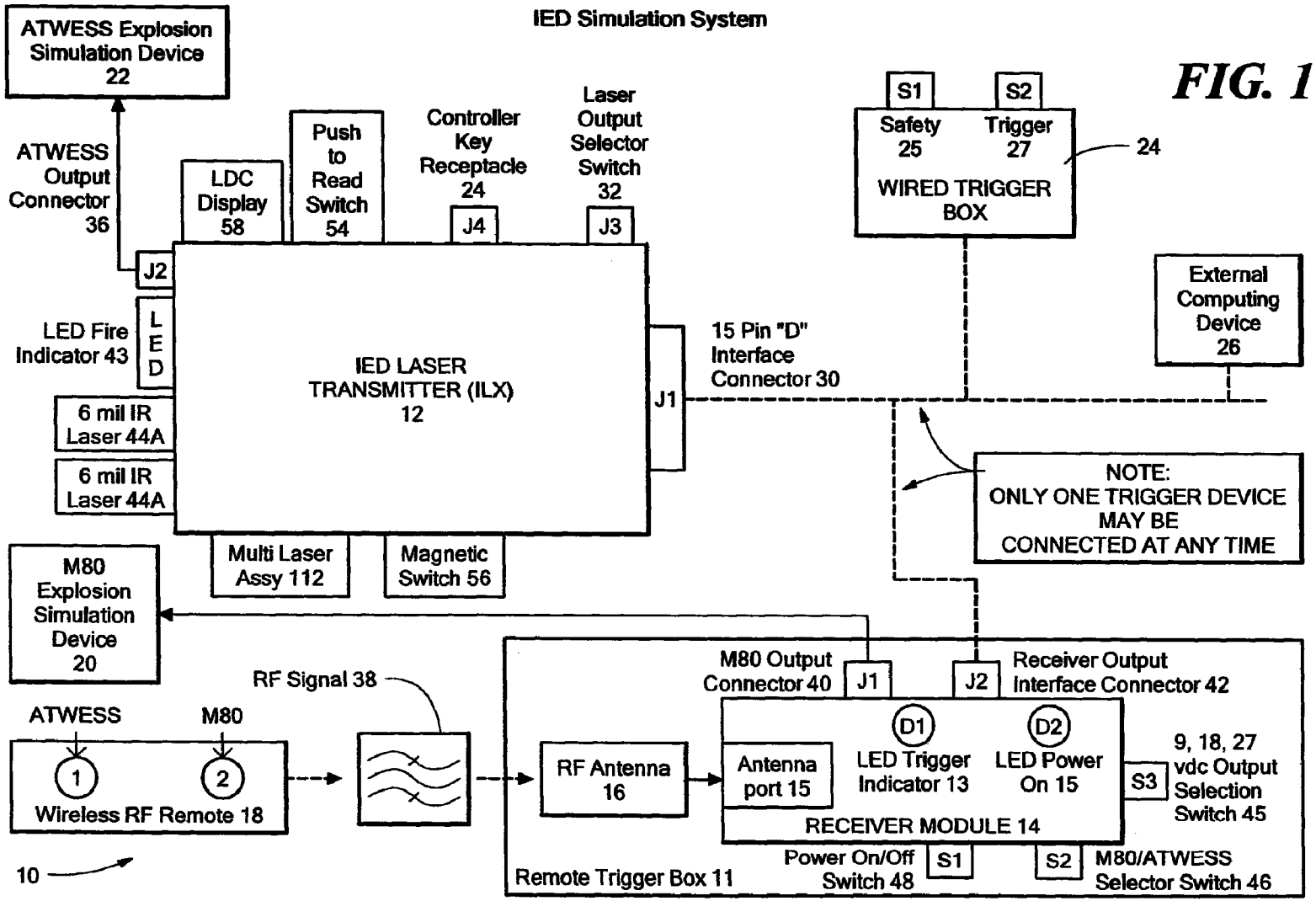
FIG. 1 is a block diagram of an IED simulation system, in accordance with one embodiment of the invention.

Throughout this document, the term "improvised explosive device" (IED) is used to describe a particular type of weapon being simulated. However, those of skill in the art will recognize that at least some embodiments of the invention are equally applicable to weapons such as rocket-propelled grenades, rifle-propelled grenades, light anti-tank weapons (LAWs), artillery, mortar, grenades, and rockets. For example, the physical appearance of the IED simulation device can readily be adapted to match the physical appearance of a weapon such as a rocket-propelled grenade, light anti-tank weapon, etc., and the physical effects (e.g., sights and sounds) that occur when the respective weapon is used can also be incorporated as part of the simulation device. In addition, note that the term "improvised explosive device" is a term of art that refers at least to any type of weapon that include an explosive charge, a detonator, and an initiation system (which can be electronic or mechanical), put together in such a way that the IED is rigged to explode.

In one aspect, the invention provides a training system for an improvised explosive device (IED) with MILES capability. The system is to be used to train personnel to respond in an appropriate manner during and following an IED event. The system can include pyrotechnic devices that can be activated when the system is triggered. The system can be triggered remotely or hardwired with trainer actions. In addition, the system, in at least some embodiments, is usable in a MILES environment to enable, for example, instrumented training events for After Action Review (AAR) training at both military home stations and at combat training centers.

For example, at least some embodiments of the invention provide the capability to simulate certain types of IED events, along with the capability of firing eye safe laser coded transmissions using the MILES code format, at near or far distances to the intended target. Existing MILES decoding systems, installed on vehicles or worn by personnel, respond to this simulated threat, to provide the user, or trainee, with necessary engagement data. Engagement data that is used to support live training criteria at the time of the event and "after action reviews" following live training events.

In one aspect of the invention, a training system for an improvised explosive device (IED) includes the capability and cabling to trigger the M80 cartridge and Anti Tank Weapons Engagement Simulation System (ATWESS), the latter being a device that, when triggered provides a flash and smoke signature which replicates the launching of various types of munitions, e.g., Rocket Propelled Grenade (IED), Viper, Stinger etc.

Also, pyrotechnic devices configured to provide an explosion simulation can be activated upon triggering of the system, and three dc voltage levels, 9, 18 and 27 VDC, are provided for user selection. Further, at least some embodiments of the invention include one or more of the following features: a magnetically actuated visible alignment laser to locate the center of the transmitted laser patterns; a removable sighting scope to aid in alignment; a spherical "Ball and Socket" housing to accommodate pointing the laser devices at the target; a trigger device wired to the IED Laser Transmitter (ILX) to enable a user to trigger the system; the trigger capability includes a wired and/or wireless device; a capability to transmit an eye safe laser "enveloped" pattern to simulate a large lethal area (67 m Long×31 m Wide×4 m High) simulating an explosion, a much smaller laser pattern (3 ft×4 ft rectangular) for longer range lethality out to 200 meters and an Infra Red LED (2 ft circular) for indoor operation at 2.5 to 5 meters; provisions for simulating different sizes of explosions are accomplished by programming the power output of the installed laser devices through the on board USB port. Simulation of different weapon types provides various MILES code lethality's by programming through the on board USB port. All of these features are described herein.

The electrical design of the IED simulation system of the invention will first be described in terms of its components, connections, and operation. The mechanical design and configuration will then be described, followed by illustrative examples of operational scenarios.

FIG. 1 is a block diagram of an IED simulation system 10 (also referred to herein as an "IED simulator"), in accordance with one embodiment of the invention. The IED simulation system 10 provides a system that simulates an IED within the MILES environment, provides various user definable configurations (modes of use) from single transmitter housing, provides a user definable detonation system (wired or wireless), and provides ranges and laser patterns for different scenarios, including 2.5 to 5 meters for indoor use, 20 to 600 meters for field "shoot back" use, and a simulated "kill pattern" of approximately 67 m long by 31 m wide by 4 meters high. The IED simulation system 10 operation and features are described further herein.

The IED simulation system 10 includes an IED laser transmitter (ILX) 12 (which is discussed in greater detail in connection with FIGS. 2 and 3); a remote trigger box 11 that houses an IED receiver module 14 and an radio frequency (RF) antenna 16; a wireless RF remote control 18; an M80 explosion simulation device 20; an ATWESS explosion simulation device 22; and a wired trigger box 24; all in operable communication with each other via associated connectors and cables that couple these elements together (or, in the case of the wireless RF remote 18, via transmitted RF signals 38). Optionally, the IED simulation system can include one or more external computing devices 26, such as personal computers, mobile phones, personal digital assistants (PDAs), notebook/laptop computers, or any other device capable of providing the required inputs to the ILX 12, such as via a USB connection at the computing device 26 to the interface connector 30 of the ILX 12. The ILX 12 is designed such that at least a portion of the transmitter parameters are programmable via the external computing device 25 connected to the interface connector 30. Advantageously, in one embodiment, all of the transmitter parameters, as well as all operation of the system 10, is programmable via the external computing device 26.

Figure 2:
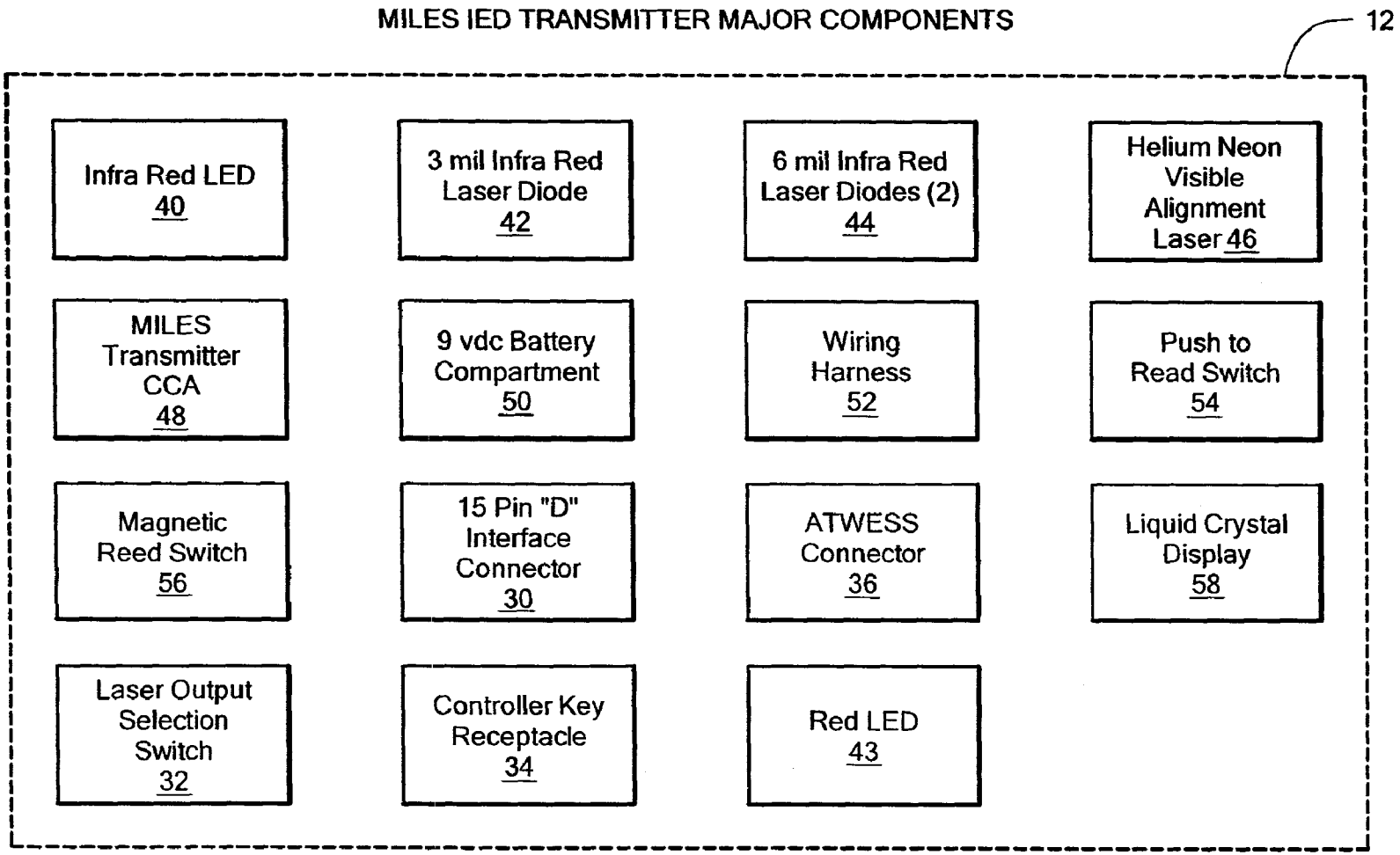
FIG. 2 is a block diagram illustrating the major components of the IED transmitter of the system of FIG. 1.
Figure 3:
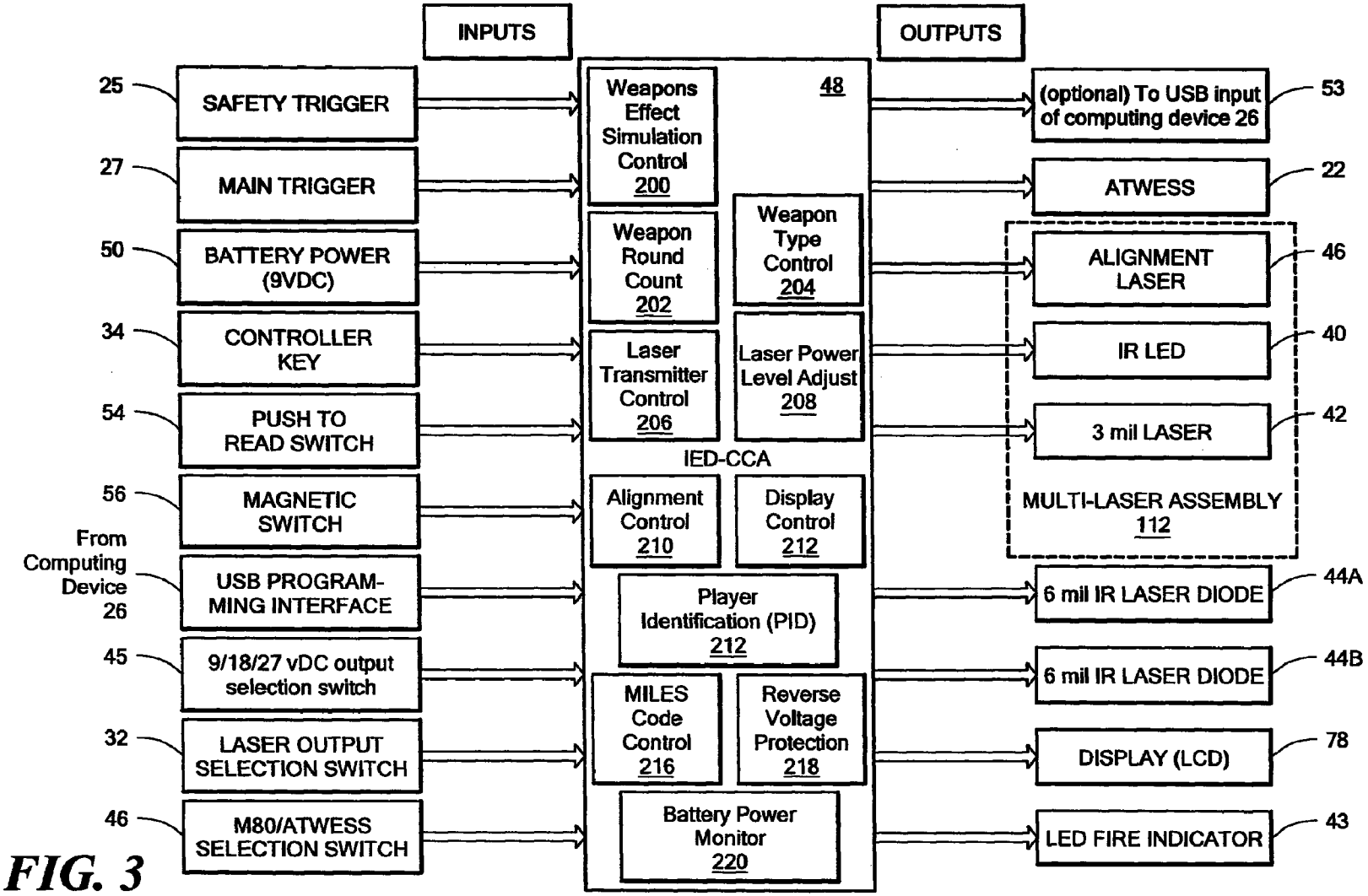
FIG. 3 is a block diagram showing inputs to and outputs from the circuit card assembly (CCA) of the IED simulation system of FIG. 1.

FIG. 2 is a block diagram illustrating the major components of the ILX 12 of the system of FIG. 1, and FIG. 3 is a block diagram showing inputs to and outputs from the circuit card assembly (CCA) 48 that is part of the ILX 12 of FIG. 1 of the IED simulation system of FIG. 1. In at least one embodiment, the CCA 48 acts as a controller for one or more functions of the ILX 12 and the IED simulation system 10.

Referring to FIGS. 1, 2, and 3, the ILX 12 includes an interface connector 30 (provided by way of illustration only as a 15 pin "D" type connector) that is capable of receiving a trigger input signal and, in cooperation with the laser output selector switch 32, the controller key receptacle 24, and the CCA 48, provides an appropriate laser output signal or ATWESS output signal in response to the trigger input signal. The trigger signal input to interface connector 30 can be a signal from the wired trigger box 24 or from the receiver output 42 of receiver 14 (the external computing device 26 is used to program the ILX 12, but in this embodiment it does not provide a trigger to the ILX 12). A trigger signal from the receiver output from the receiver 14 can either be a signal from the wireless RF remote 18 that was received on RF antenna 16, or can be a signal based on the selection made ate the M80/ATWESS selection switch 46. Only one trigger device is connected to the ILX interface connector 30 at any time, to avoid conflicts.

The laser output selection switch 32 in this example embodiment is a user-selectable sliding switch that allows a user to select between three types of available laser outputs, each of which provides variable ranges and laser patterns for different simulation scenarios. The selected laser outputs include Infrared (IR), which is used to simulate an indoor IED detonation/explosion (2.5 to 5 meters of laser range); 3 mm wavelength laser ("3 mil"), used to simulate a so-called long range (20 to 600 m of laser range); "shoot back" situation; and a pair of 6 mm wavelength lasers ("6 mil"), which is used to simulate an outdoor IED detonation/explosion having a laser range "kill pattern," in this example embodiment, of approximately 67 m long by 31 m wide by 4 m high. The selected laser output is projected through either 6 mil IR laser outputs 44A, 44B or the outputs of the multi-laser assembly 112. The 6 mil IR laser outputs 44A, 44B and the multi-laser assembly 112 are described further herein.

The controller key receptacle switch 34 (also referred to herein as a weapon switch) of the ILX 12, is usable with a controller key, in a manner similar to the manner as described and illustrated in a related co-pending application Ser. No. 11/330,902, entitled "Simulation Devices And Systems For Rocket Propelled Grenades And Other Weapons," which is hereby incorporated by reference in its entirety. Briefly, the controller key receptacle switch 34 for the IED simulation system 10 has three positions: ATWESS, M80/DRY FIRE, and RESET. and cooperates with the CCA 48 and the M80/ATWESS selection switch 46 in the receiver 14 to set the IED simulation device 10 in one of several operating modes.

In at least one embodiment, a controlling operator has a key (i.e., a so-called "green" master key or a yellow field operations key) that fits the controller key receptacle 34 and is capable of resetting the ILX 12, putting the IED simulation device 10 into a so-called "Dry Fire" mode (with no ATWESS, e.g., no smoke, where the M80 explosion simulation device (a pyrotechnic device) is instead used to simulate an explosion) or putting the IED simulation device 10 into an ATWESS mode (a mode in which an ATWESS cartridge is used as part of the simulation).

The ILX 12, via its multi-laser assembly 112 or its 6 mil lasers 44A, 44B, sends a laser signal, such as a pulse of laser energy and/or eye-safe, invisible laser (light) beams, toward the target. If the laser beam hits the target, detector assemblies on the target sense the beam and cause an alarm to sound. In addition, if the target is a vehicle, building, or other object, an externally-mounted light on the vehicle, building, or other object, will flash.

Optionally, the operator of the IED simulator device 10 may wear a harness or vest equipped with a laser detector assembly and alarm and which also includes a similar controller key receptacle switch 34. The laser detector can, for example, be a detector usable with a MILES-type of system. If a MILES-equipped weapon fires a laser signal at the operator of the IED simulator device 10, one of two results may occur: if it is a "near miss" the alarm on the harness sounds for one second; if it is a "hit", the alarm sounds continuously and the operator has been "killed". The operator's yellow weapon key can be removed from the IED simulator device 10 and inserted into the controller key receptacle switch 34 (on the harness) to shut off the alarm. In one embodiment, only the green master key can perform a system reset on the IED simulator device 10 (which provides for a new set of rounds).

The push to read switch 54 is a switch that cooperates with the CCA 48 to cause the LCD display 58 to display information to a user. For example, the operator of the IED simulation device 10 can press the push to read switch 54 to see on the LCD display 58 information about player identification (PID), rounds remaining, weapon type, and battery level indicators.

The ATWESS output connector 36 of the ILX 12 provides an output signal to trigger the ATWESS explosion simulation device 22. The ATWESS explosion simulation device 22 is a type of physical effect simulator that uses an ATWESS cartridge (not shown) and is able to provide one or more indicators or physical effects, such as a realistic weapon signature, including muzzle flash, noise, and backblast smoke, any one or more of which may be appropriate for the simulation of an IED. When the IED simulation system 10 is detonated (i.e., a round is fired), the ATWESS optionally can provide an audible sound equivalent to the sound a real IED round would make, as well as a blast of smoke similar to that produced during the firing of a "real" IED. ATWESS simulation devices are available from various vendors, including Cubic Defense Systems of San Diego, Calif.

For the ILX 12 to provide an ATWESS output trigger signal, the controller key receptacle 24 of the ILX 12 must be set to ATWESS and the M80/ATWESS selection switch 46 of the receiver 14 must also be set to ATWESS. Although the explosion simulation device 22 of FIG. 1 is shown to be an ATWESS type of device, those of skill in the art will appreciate that other simulator devices and/or physical effect simulators that are capable of producing audio and/or visual effects are usable in place of the ATWESS.

The LED fire indicator 43 of the ILX 12 (also referred to herein as "Red LED 43") is illuminated when the ILX 12 is appropriately triggered to generate an output laser signal or an output ATWESS. For example, the LED fire indicator 43 is illuminated when the safety switch 25 is first pressed at the wired trigger box 24 followed by pressing the trigger switch 27 at wired trigger box 24, which "fires" (triggers) the IED simulation; note also the LED trigger indicator 13 on the receiver 14 also illuminates when this occurs.

The ILX 12 also includes an alignment laser 46 (which is part of the multi-laser assembly 112), and the alignment laser 46 is magnetically actuated via the magnetic switch 56. The alignment signal is used to align the MILES laser signals that are output from the 6 mil laser outputs 44A, 44B and/or the multi laser assembly 112. The laser alignment signal 46 is activated when a magnet is placed in proximity to the magnetic switch 56, which in this example embodiment is when a magnet is placed over the caution label on the ILX 12 housing (the location of the caution label on the housing can be seen in FIG. 15). The magnetic switch 47 communicates with the CCA 48 to activate a Helium Neon Laser Tube located within the multi-laser assembly 112. The alignment laser is a red visible laser that is aligned to the center of the three laser patterns (visible IR, 3 mil, and 6 mil).

Figure 15:
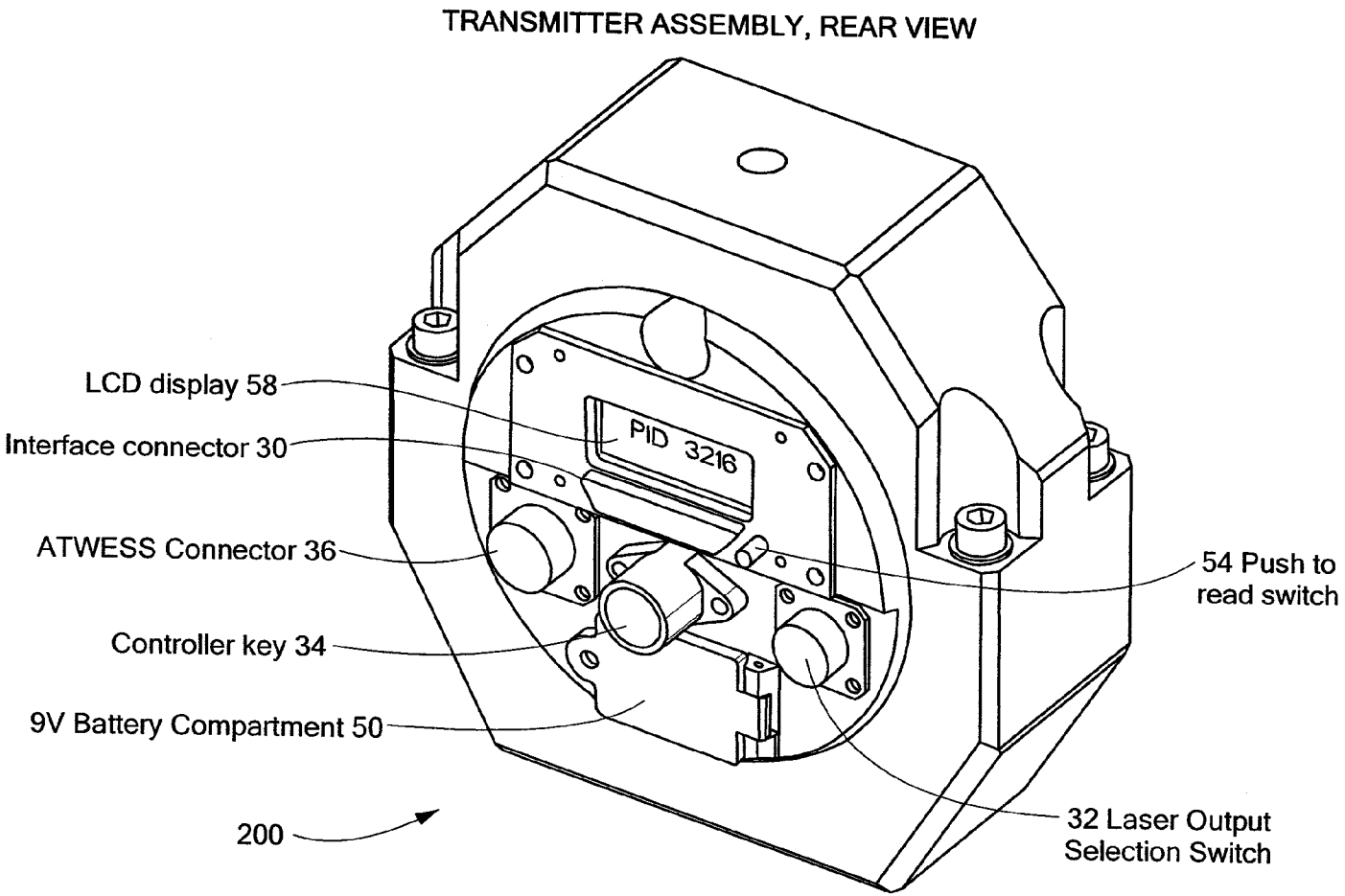
FIG. 15 is a rear view of the back transmitter assembly of FIG. 14.

The ILX 12 also includes a user-accessible compartment for a 9-volt battery 50 (not shown in the block diagram of FIG. 1), the location of which is shown further herein in FIG. 15. The CCA 48 monitors the terminals of the 9-volt battery 50, to monitor the battery voltage and, if necessary, provide a "low battery" indicator on LCD display 58 of the LCD assembly 58.

As illustrated in FIG. 3 and as described herein, the CCA 48 acts as a controller for the IED simulation system 10. FIG. 3 is functional block diagram of the CCA 48 and its inputs and outputs, as used with the IED simulation device 10 of FIG. 2. The inputs to the CCA 48 include the settings of signals from the safety trigger switch 25 and main trigger switch 27 (of the wired trigger box 24), signals monitoring the power/voltage level of the battery 50, the setting of the controller key receptacle switch 343 the setting of the push to read switch 54, the setting of the magnetic switch 46, inputs (if any) from a computing device 26 (e.g., from the computing device's universal serial bus (USB) programming interface, the setting of the M80/ATWESS selection switch 46, and the setting of the 9/18/27 volt DC output selection switch 45.

The outputs of the CCA 48 include a signal controlling the ATWESS 22, signals to the display 89 and the red LED fire indicator 43, optional data to the USB port of the external computing device 26, signals directed to energize the 6 mil IRS laser diodes 44A, 44B, and signals directed to energize one or more of the lasers in the multi-laser assembly 112.

The CCA 48 itself includes functionality providing weapons effect simulation control 200 (to control the ATWESS 24); weapon round count 202 (where the round count can relate to a specific weapon type via the weapon type control 204), laser diode control signals 206; signals to control the laser power level adjustment 208 (including hit and near miss laser power level adjustment); signals to control alignment 210; signals to control the display 212 (including display of PID, programmable weapons-specific rounds count and rounds remaining, if needed, weapon type, and battery low indicators); capability to track up to 5280 player identification codes (PID) (e.g., Enhanced MILES PID); encoding of all existing MILES codes 216; providing reverse voltage protection 216; monitoring battery power 220; and tracking player identification (PID) (e.g., via a 5280 Enhanced PID).

In one embodiment, the CCA 48 can be programmed to vary the size of the "kill pattern" produced by laser diodes by varying the output power levels of the signals driving the laser outputs (e.g., outputs 40, 42, and/or 44A and B of FIG. 3). The size of the kill pattern is described further herein.

Referring again to FIG. 1, the receiver 14 includes an M80 output connector 40 capable of transmitting a triggering signal to another physical effect simulator, such as the M80 or other pyrotechnic explosion simulation device(s) connected thereto, where the signal will be sent if the M80/ATWESS selection switch 46 is set to M80. The size of the simulated explosion is dependent on the voltage selected at the output selection switch 45 and on the particular type of explosive or pyrotechnic device being triggered. For example, certain types of explosive devices may be triggered by a 9 volt signal, others by an 18 volt signal, and others by a completely different voltage signal (e.g., 5 VDC) and so on. Those of skill in the art can tailor the voltage selected (and/or provided) based on the particular device(s) being used. The illustrated voltages of 9, 29, and 27 VDC are not limiting, but merely illustrative.

Note also that the M80 is but one example of a type of pyrotechnic device usable with the invention. Pyrotechnics are devices that are ignited and undergo an energetic chemical reaction at a controlled rate intended to produce, on demand in various combinations, specific time delays or quantities of pyrotechnic effects such as heat, noise, smoke, light, or infrared radiation, alone or in combination, to produce a desired effect, such as sending a signal, illuminating an area, simulating a weapon during training, and/or serving as an ignition element for another weapon. Pyrotechnic devices such as the M80 simulator are designed to explode and are used as military simulators for rifle or artillery fire, hand grenades, booby traps, and, in the present invention, IEDs, and are designed to explode. An exemplary M80 simulator consists of a cylinder made of paper or other combustible material, containing a charge composition capable of simulating the pyrotechnic effect of, for example, an eighth of a stick of dynamite.

Referring again to FIG. 1, the antenna port 45 of the ILR 13 is programmed to receive the RF signals emanating from channel 1 of the wireless RF remote 18 (i.e., the ATWESS selection) and from channel 2 of the wireless RF remote 18 (i.e., the M80 selection).

The receiver 14 also include a receiver output interface connector 42 that transmits trigger and control signals to interface connector 30 of the ILX 12. The signals that the receiver 14 sends to the ILX 12 include the setting of the output selection switch 45 (e.g., if ATWESS is selected) and the signal received (if any) from channel 1 of the wireless RF remote 18. A signal received from channel 1 indicates that a user is attempting to trigger the firing of the ATWESS 22. Firing of the ATWESS will only occur, however, if both the M80/ATWESS selection switch 44 and the controller key receptacle 24 of the ILX 12 are set to ATWESS. If the ATWESS trigger (or any other trigger) is received from the wireless RF remote 18, then the LED trigger indicator 13 is illuminated.

The receiver 14 includes two indicators in the form of LED indicator diodes: the LED trigger indicator 13 (described previously) and the power on LED 15, which is illuminated when the power on/off switch 48 of the receiver 14 is set to "on".

Referring again to FIG. 1, the wired trigger box 24 can be coupled to the ILX 12 via a cable connected to the interface connector 30 and used to trigger a laser output or, if the ATWESS is attached to the ILX 12, ATWESS output from the ILX. The wired trigger box 24 is used by first pressing the safety switch 25 and then pressing the trigger switch 27 to fire. When both these switches are pressed in this order, the LED indicator 43 on the ILX 12 and the LED trigger indicator 13 in the receiver 14 (within the remote trigger box 11) are both illuminated.

The mechanical design of the IED simulation system 10 will now be described. It should be understood that the particular mechanical design and configuration described herein is merely illustrative and not limiting; those of skill in the art will appreciate that many different mechanical designs and configurations are usable with the invention.

Figure 4:
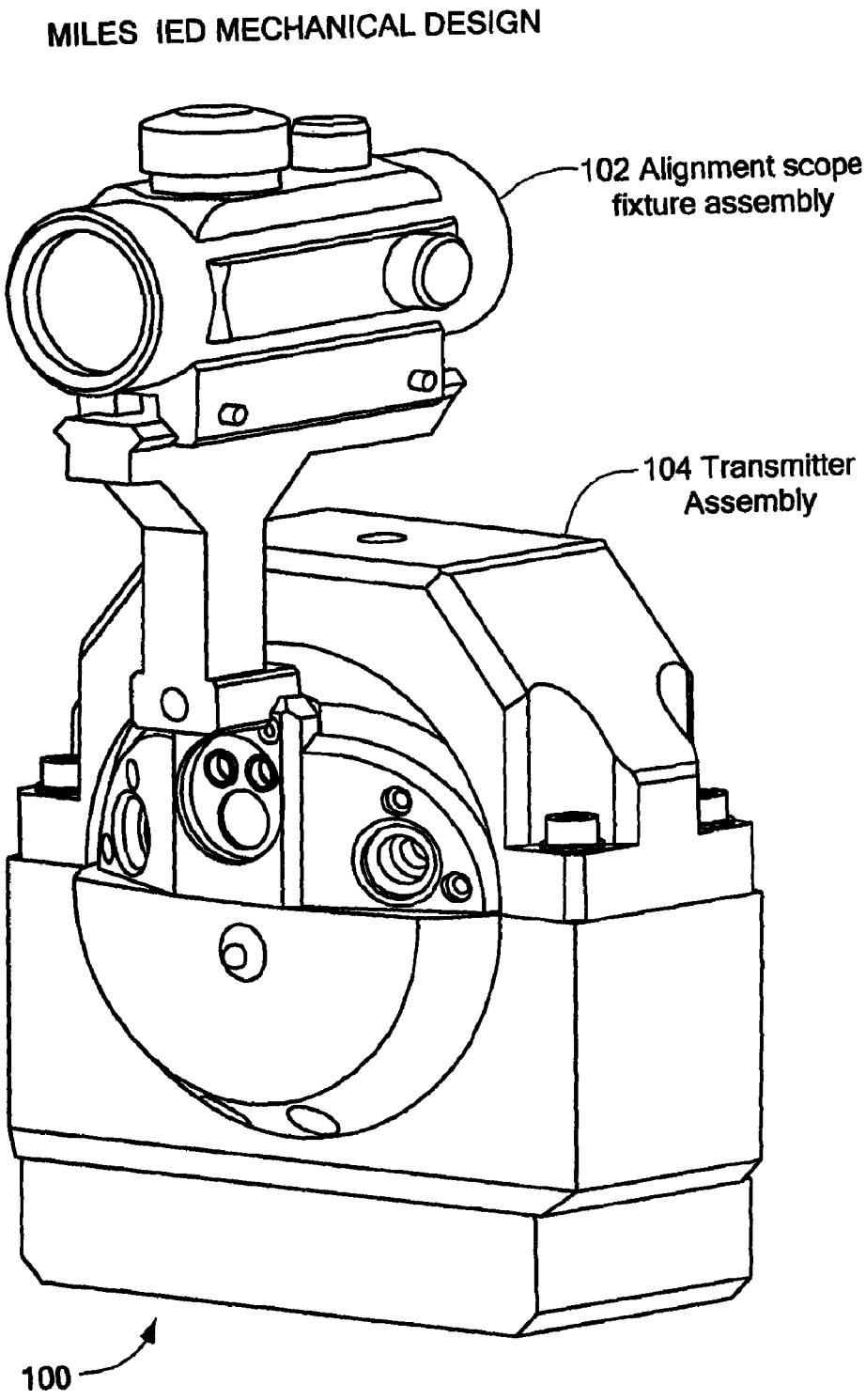
FIG. 4 is a front left perspective view of the mechanical design of the IED simulation system of FIG. 1, in accordance with one embodiment of the invention.

FIG. 4 is a front left perspective view of the mechanical design of the IED simulation system 10 of FIG. 1, in accordance with one embodiment of the invention. FIG. 4 illustrates the IED simulation system assembly 100, which consists of two major assemblies, the alignment scope fixture assembly 102 and the transmitter assembly 104.

The alignment scope fixture assembly 102 includes a 20 mm adjustable "red dot" scope having 1× magnification, such as the Model Red Dot 30, from USA Optics, Inc. of Ft. Lauderdale, Fla. The alignment scope fixture assembly 102 is mounted to a machined bracket, such as the so-called "Picatinny Rail bracket" (described and illustrated in the commonly assigned and related U.S. patent application Ser. No. 11/330,902, entitled "Simulation Devices And Systems For Rocket Propelled Grenades And Other Weapons," which is incorporated by reference herein) and is removably attached to the transmitter assembly 104, such as by using a thumb screw.

Figure 5:
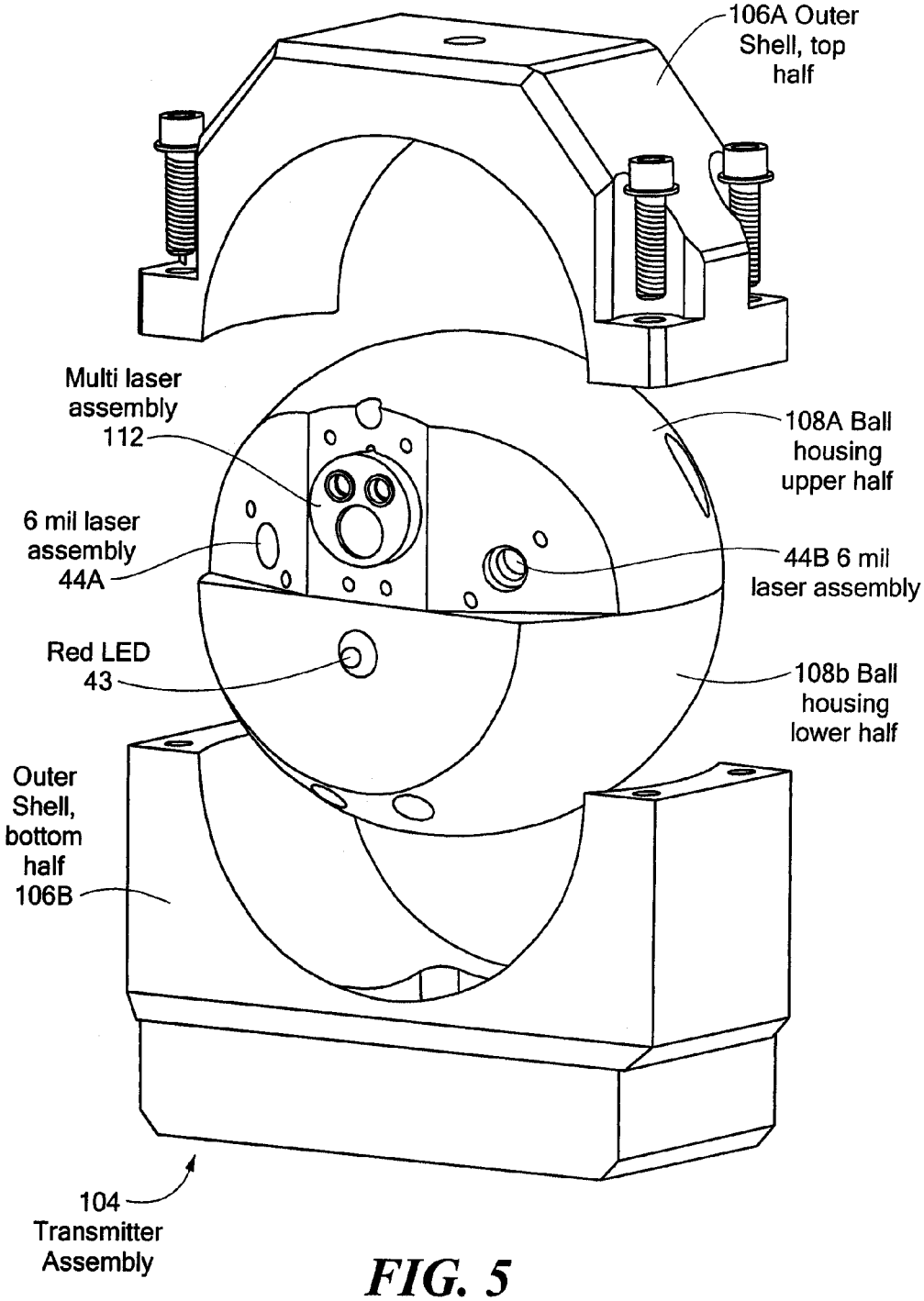
FIG. 5 is an exploded view of the transmitter assembly portion of the IED simulation system of FIG. 4.

FIG. 5 is an exploded view of the transmitter assembly 104 portion of the IED simulation system assembly 100 of FIG. 4. The transmitter assembly 104 includes an outer shell 106 and a ball housing 108. The outer shell 106 consists of an outer shell top half 106A and an outer shelf bottom half 106B, coupled together via set screws. The outer shell 106 also can include a battery compartment (not shown). The ball housing 108 has an upper half 108A and a lower half 108B, and each half of the ball housing can be made from virtually any material capable of meeting the operational requirements of the IED simulation system, which in this example embodiment include a requirement that the transmitter be water resistant. The ball housings 108A, 108B, along with the other housings described herein, can be implemented in many different ways, out of many different materials dust like an actual IED). Advantageously, the materials used are substantially rigid and rugged materials, such as metal and/or polypropylene thermal plastic.

In one embodiment, the ball housings 108A, 108B are machined out of aluminum (6061 T6 or 5.5×5.5×4) and hard anodized in block or olive drab to protect the housings from environmental exposure. The ball housings 108A, 108B include military-specification quality helical inserts in all threaded holes, for maintenance purposes.

Figure 6:
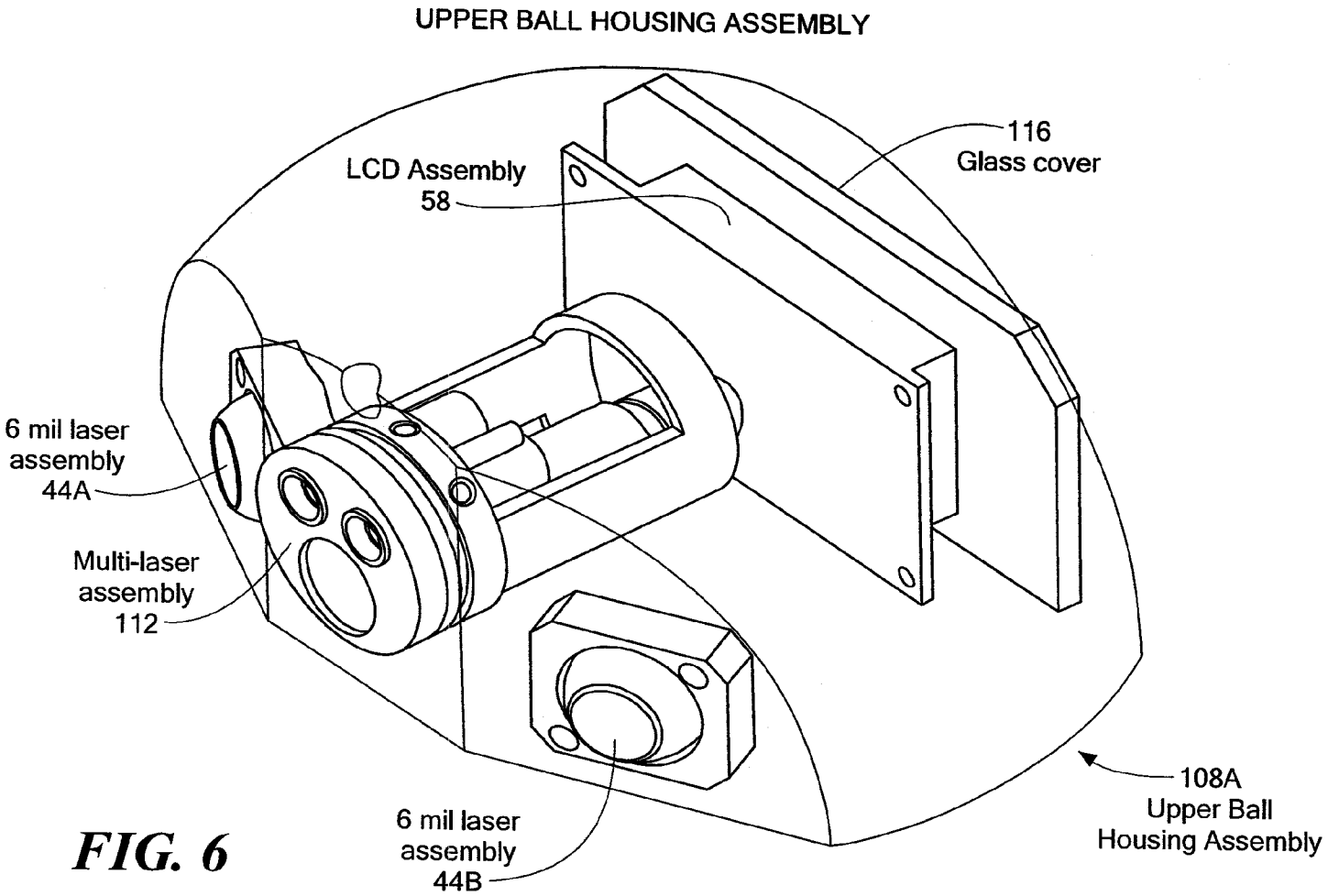
FIG. 6 is a transparent view of the upper ball housing assembly of the transmitter assembly portion of the IED simulation system of FIG. 4.

FIG. 6 is a transparent view of the upper ball housing assembly 108B of the transmitter assembly portion 100 of the IED simulation system 10. The upper ball housing assembly 108A has mounted within it the 6 mm laser assemblies 44A, 44B, the multi-laser assembly 112, the LCD assembly 58, and a glass cover 116 for the LCD assembly 58. The ball housing in this embodiment has a substantially round or spherical shape, to accommodate pointing lasers at the target and alignment of the laser signal.

Figure 7:
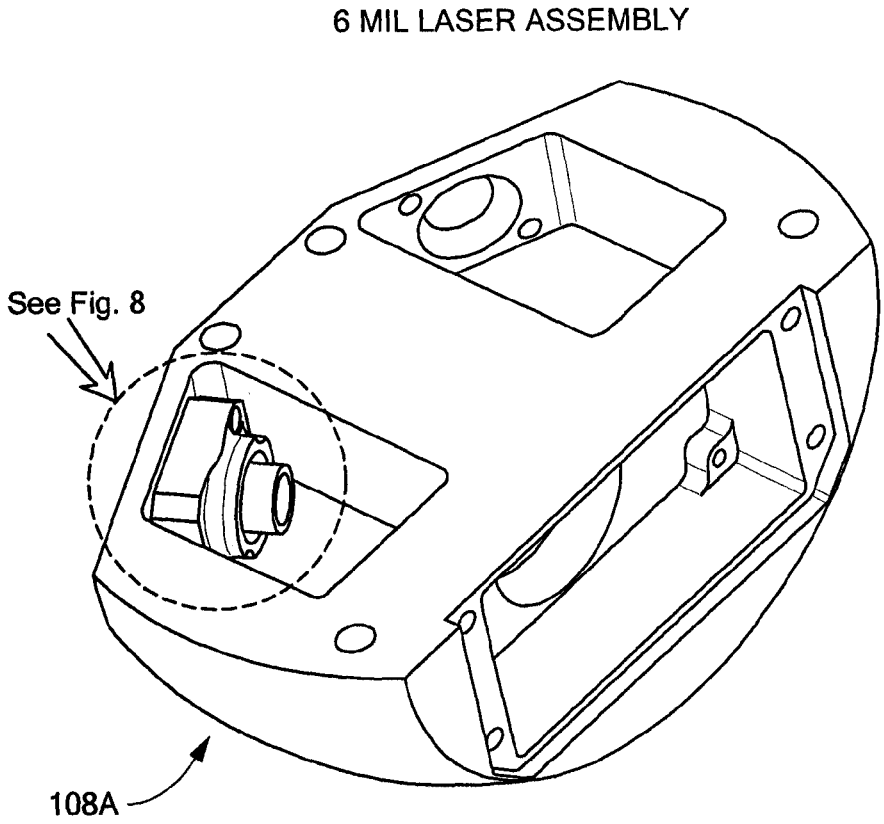
FIG. 7 is a view taken from the bottom of the upper ball assembly of FIG. 6, showing placement of the 6 mil lasers.
Figure 8:
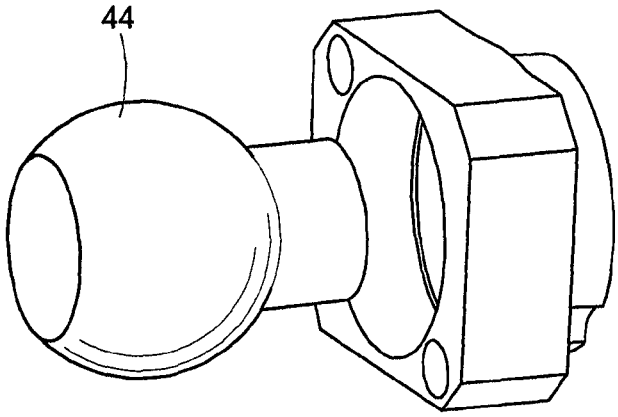
FIG. 8 is an enlarged view of the dotted section shown in FIG. 7, showing the mounting of the 6 mil laser.

FIG. 7 is a taken from the bottom of the upper ball assembly of FIG. 6, showing placement of the 6 mm lasers 44A, 44B within the upper ball joint housing 108A, and FIG. 8 is an enlarged view of the dotted section shown in FIG. 7, showing the mounting of the 6 mil laser. Referring to FIGS. 7 and 8, the upper ball joint housing 108A housing for the 6 mm laser 44 is able to maneuver up to sixty degrees about its center line, enabling the transmitter to enlarge the "kill" pattern for the 6 mm laser 44 to 31 meters wide (e.g., for outdoors use of the IED simulation system 10). The 6 mm laser diode 44 is fixedly attached (e.g., via cement) and aligned in the upper ball joint housing 108A.

Figure 9:
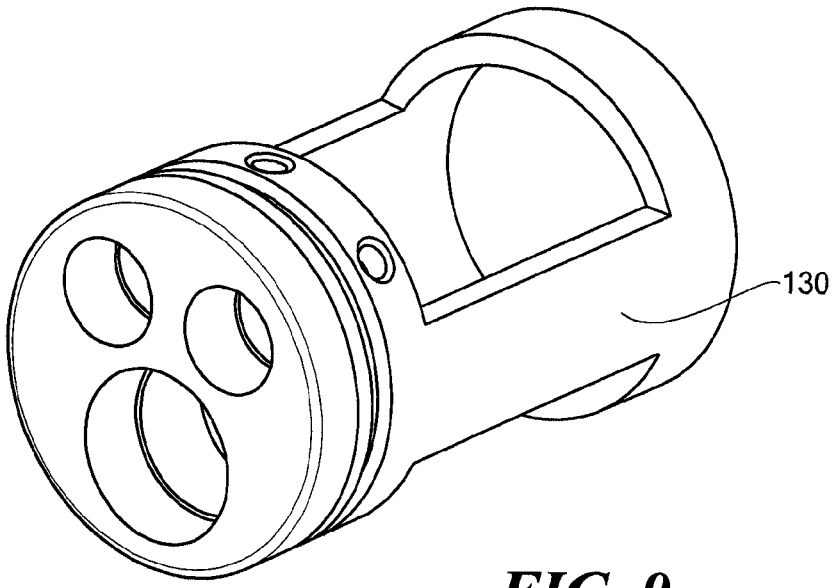
FIG. 9 is a perspective view of a housing used to maintain the laser transmitters in a predetermined orientation, in accordance with one embodiment of the invention.
Figure 10:
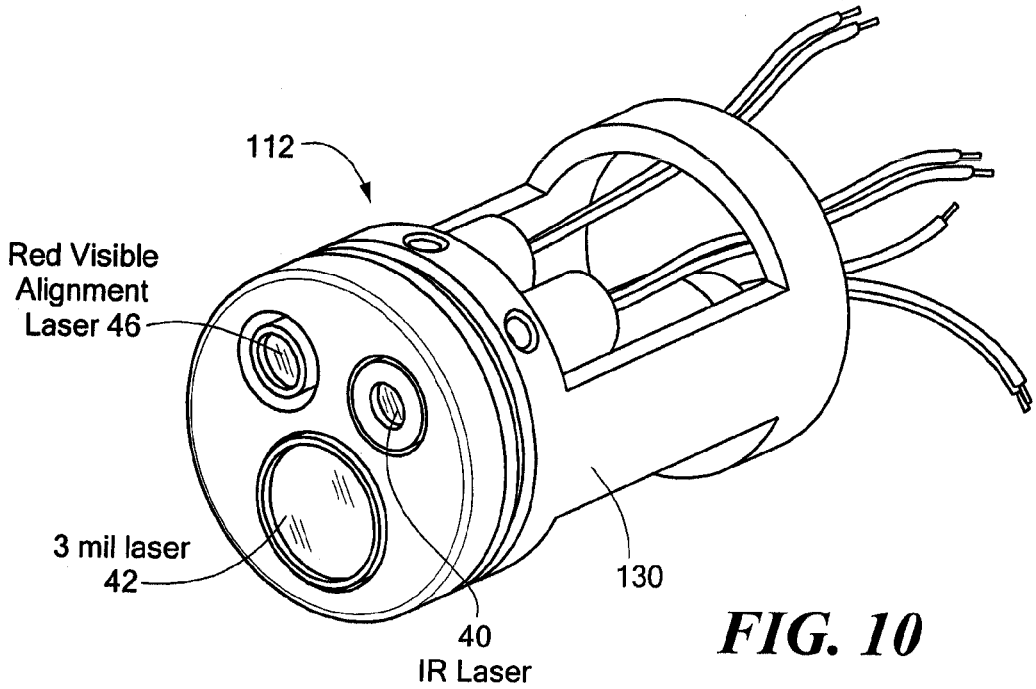
FIG. 10 is an illustration of a multi-laser assembly used with the IED simulation system of FIG. 1.

FIG. 9 is a perspective view of a housing 130 used to maintain the laser transmitters in a predetermined orientation, in accordance with one embodiment of the invention, and FIG. 10 is an illustration of a multi-laser assembly 112 used with the IED simulation system 10 of FIG. 1. Referring to FIGS. 9 and 10, the housing 130 houses a red visible alignment laser 56 (such as tube-type laser transmitter capable of generating a red laser "pointer" type beam for alignment purposes), a 3 mm laser 42 for shoot back application. The 3 mm laser, in one embodiment, is implemented using a small arms transmitter (SAT) laser tube that is about 1.75 inches long and 0.5 inches in diameter, having a laser range from 20 to 600 meters. In one embodiment, the IR laser 40 uses a so-called MOCVD (metal organic chemical vapor deposition) type of laser, which is an infra-red, non-visible laser, available from Laser Diode, Inc., of Edison, N.J.

Figure 11A:
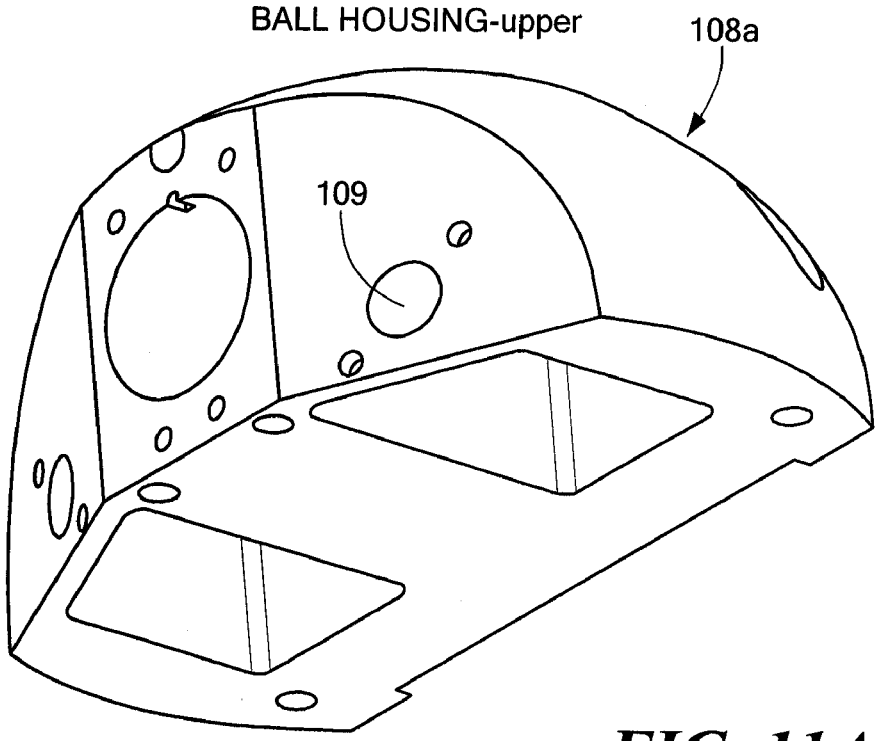
FIG. 11A is a view of the upper ball housing of the upper ball assembly of FIG. 6, as viewed from the front and bottom.
Figure 11B:
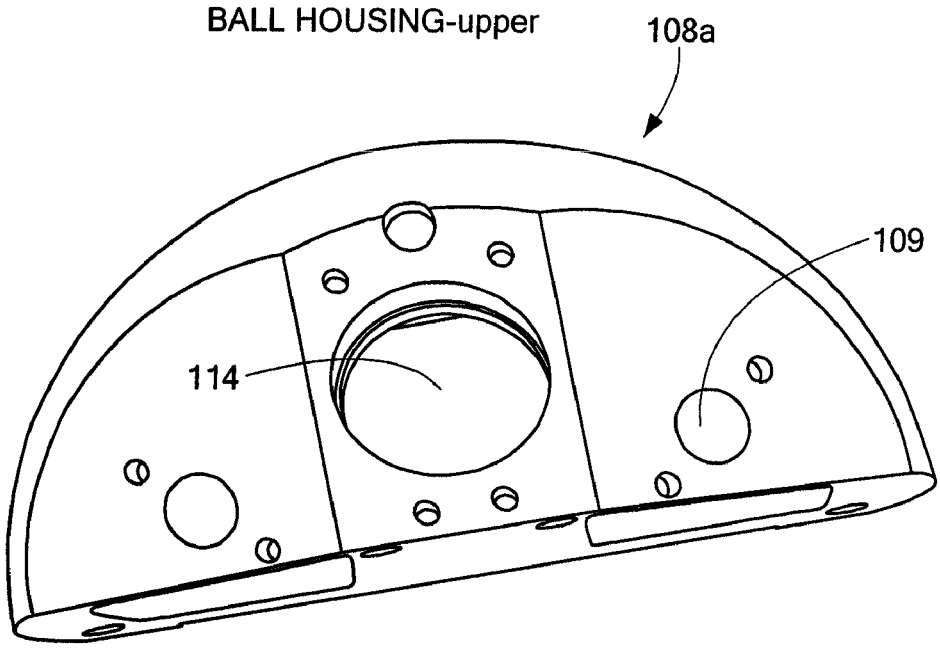
FIG. 11B is a view of the upper ball housing of the upper ball assembly of FIG. 6, as viewed from the front.
Figure 11C:
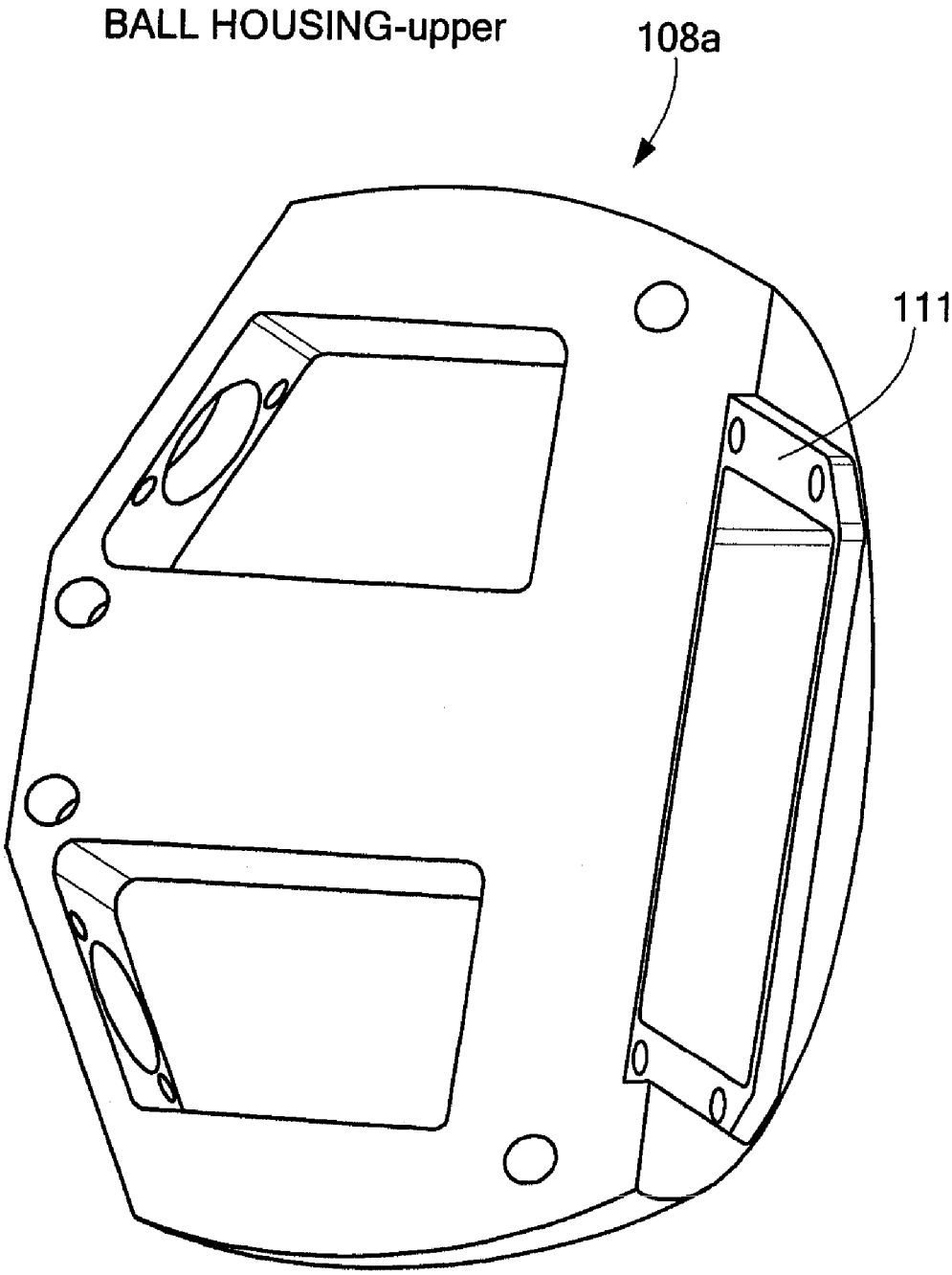
FIG. 11C is a view of the upper ball housing of the upper ball assembly of FIG. 6, as viewed from the bottom and rear.

FIG. 11A is a view of the upper ball housing 108A of the upper ball assembly of FIG. 6, as viewed from the front and bottom, illustrating how the upper ball housing 108 includes two pocket compartments 109 providing space to install the 6 mm laser transmitter assemblies 44A, 4413 FIG. 11B is a view of the upper ball housing of the upper ball assembly of FIG. 6, as viewed from the front, showing the precise cylindrical cut-out 114 for the multi-laser housing 130 to be pressed in. FIG. 11C is a view of the upper ball housing 108A of the upper ball assembly of FIG. 6, as viewed from the bottom and rear, showing the back pocket 111 with stand off to mount the LCD assembly 58.

Figure 12:
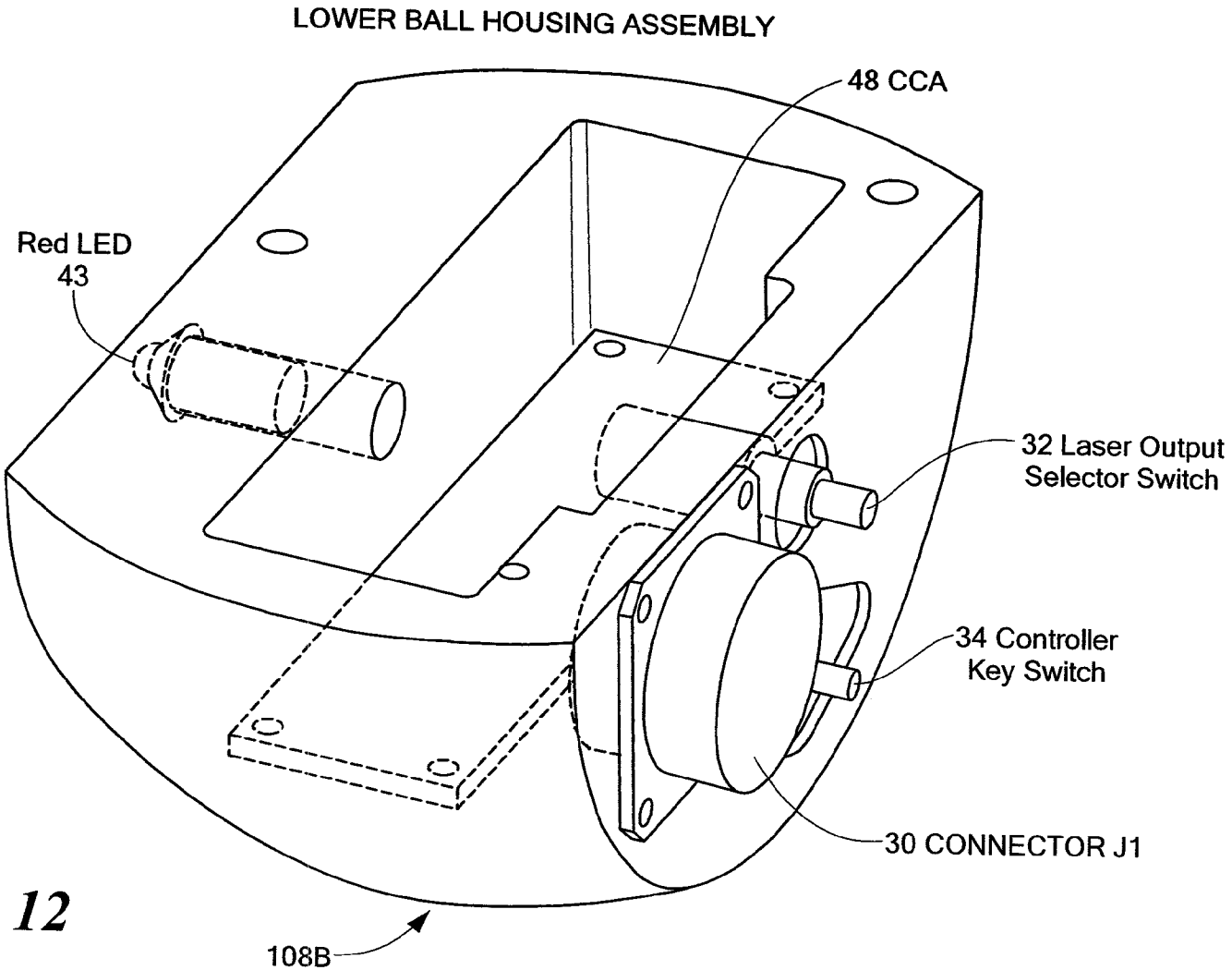
FIG. 12 is a transparent view of the lower ball housing assembly of the transmitter assembly portion of the IED simulation system of FIG. 4.
Figure 13:
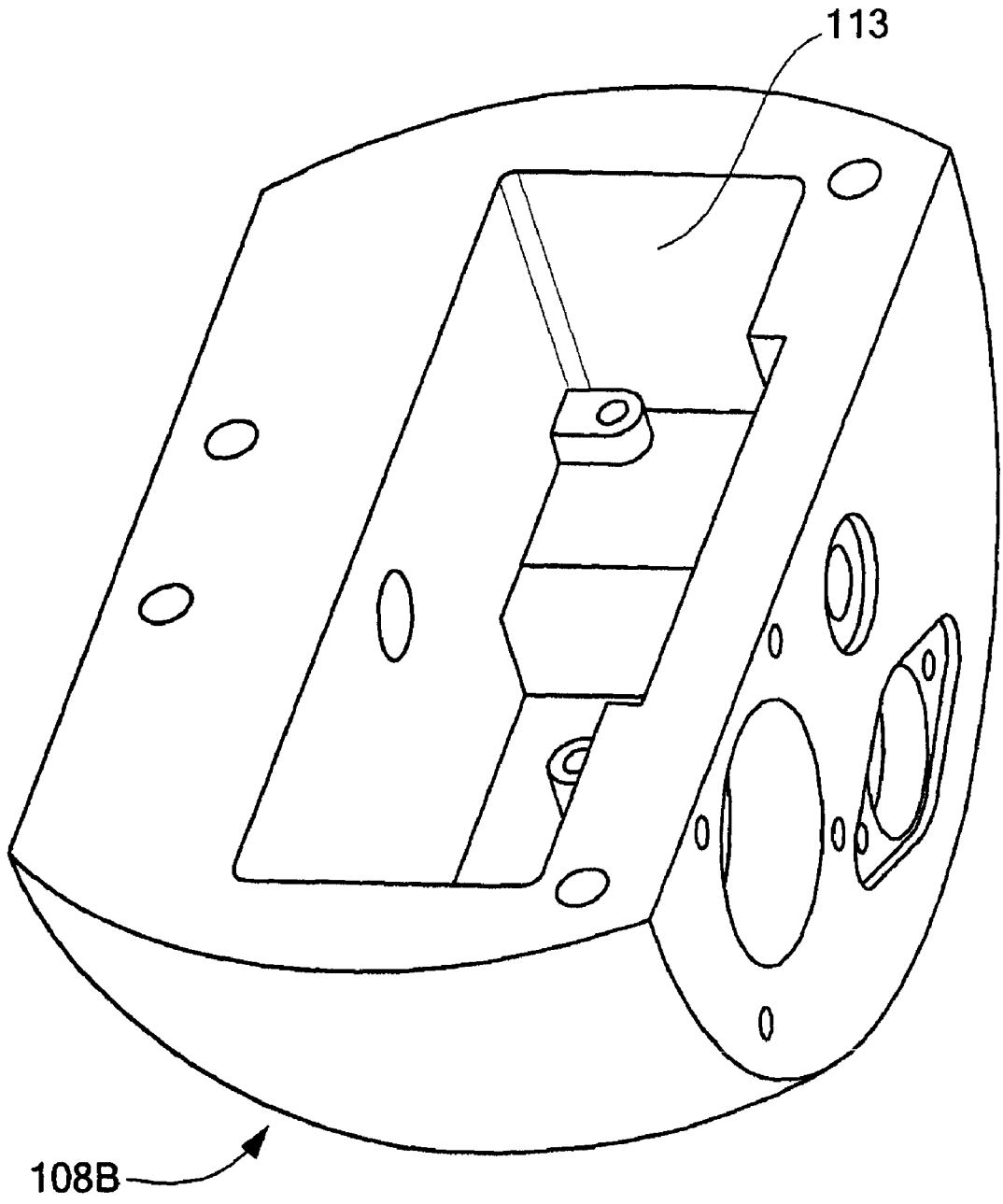
FIG. 13 is a view of the lower ball housing, for the IED simulation system of FIG. 4.

FIG. 12 is a transparent view of the lower ball housing assembly 108B of the transmitter assembly portion of the IED simulation system 10 of FIG. 1, illustrating how the lower ball assembly 108B includes the CCA 48, the laser output selector switch 32, the controller key switch 34, the interface connector 50, and the red LED 43. FIG. 13 is a view into the lower ball housing 108B, showing a deep machined pocket 113 for mounting the CCA 38 and various cut outs for the controller key switch, laser output selector switch 32, and interface connector 30.

Figure 14:
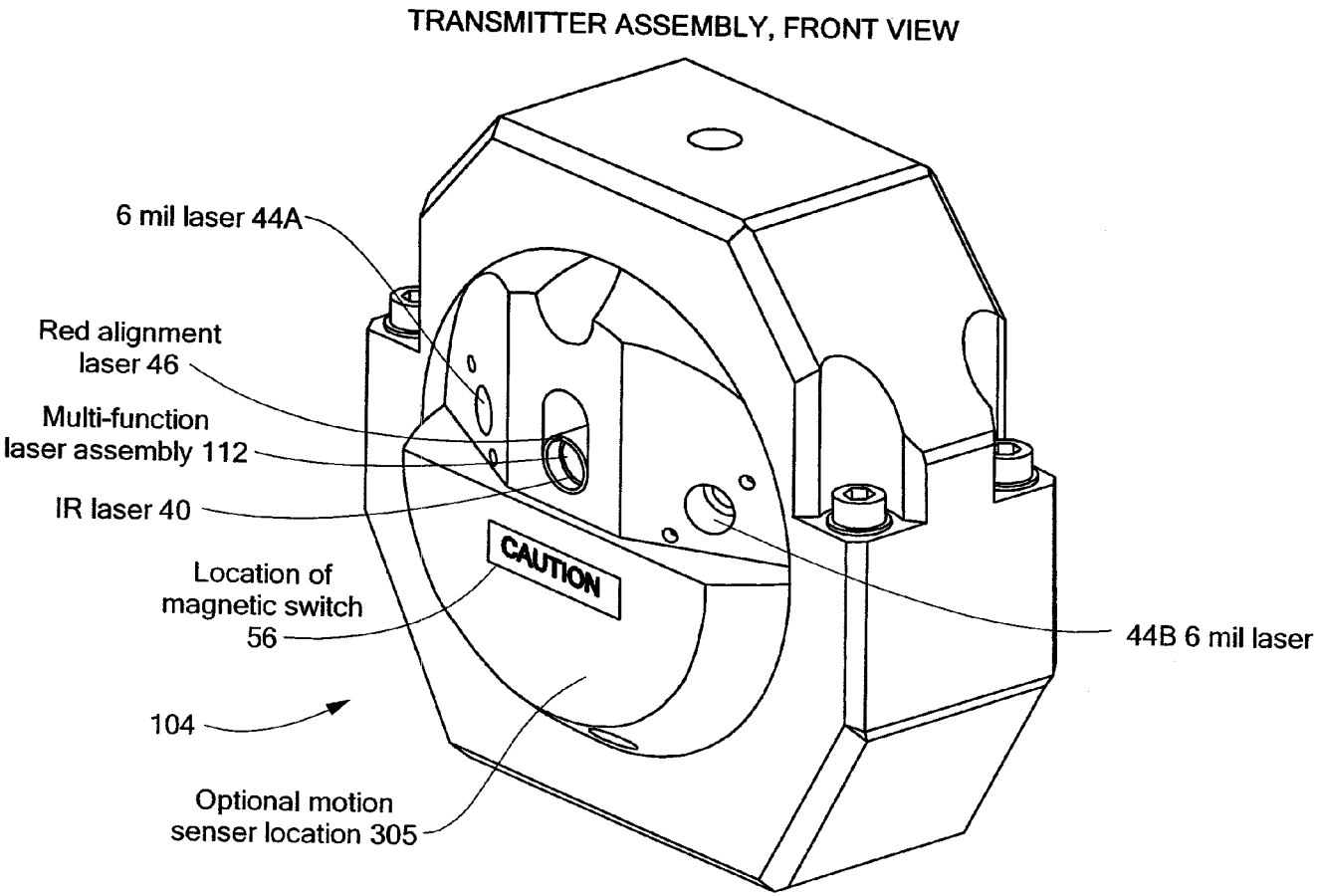
FIG. 14 is a front view of a transmitter assembly, in accordance with one embodiment of the invention.

FIG. 14 is a front view of a transmitter assembly 104, in accordance with one embodiment of the invention. The transmitter assembly 104 consists of a transmitter 12 (such as the transmitter/ILX 12 of FIG. 1) mounted into a housing, such as the outer shell 106. In this embodiment, the housing 106 has a slightly different external appearance than that of the outer shell housing 106 of FIGS. 4 and 5; however, it will be appreciated that virtually any style or design of housing is usable provided it permits the lasers of the IED to be directed as desired. As seen in the front view of FIG. 14 and as described previously, the transmitter 12 includes a pair of 6 mm laser outputs 44A, 44B and a multi-laser assembly 112 (including a red alignment laser 46, and an IR laser 20). In one embodiment of the invention, a motion sensor (not shown) is mounted at externally at location 305, the motion sensor configured to trigger a simulated detonation of the IED (e.g., trigger a laser output and/or an ATWESS output) should motion be sensed.

FIG. 15 is a rear view of the transmitter assembly 104 of FIG. 14, showing the location of the LCD display 58, the interface connector 30, the ATWESS output connector 36, the controller key 34, the 9V battery compartment 50, the laser output selector switch 32, and the push to read switch 54.

The IED simulation system 10 described herein can be used by placing the transmitter (ILX) 12 and its transmitter assembly 104 virtually anywhere, just as a "real" IED can be placed anywhere, then connecting it to the other components of the system 10, as needed, so that it can be triggered in the desired mode (e.g., IR, shoot back, ATWESS, etc), as described previously. For example, the ILX 12 or the entire transmitter assembly 104 can be hidden inside a building or (or even an object) so long as the laser signals are not blocked), mounted to an object, or placed in a desired location.

Figure 16:
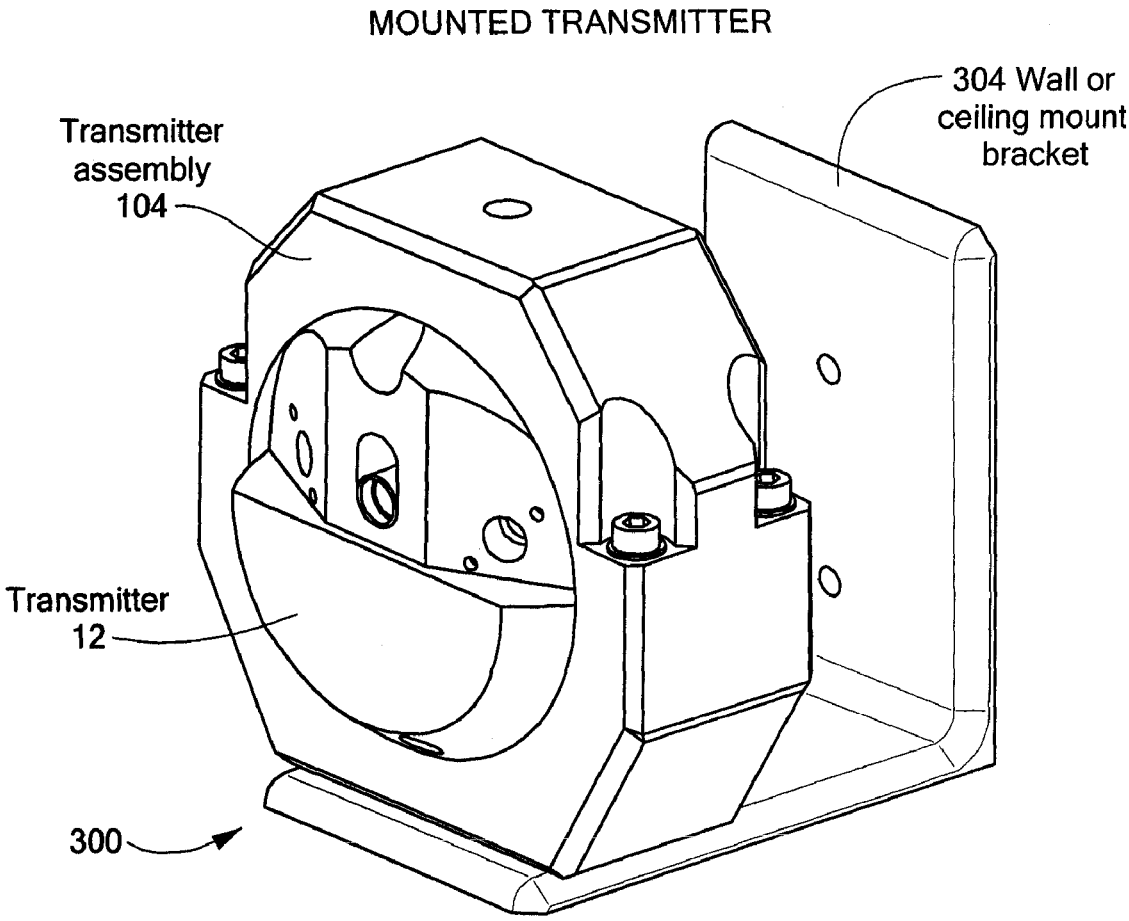
FIG. 16 is an illustration of the shoot back transmitter assembly of FIG. 14 as mounted to a wall or ceiling mount bracket.

Several additional modes of operation for the IED simulation system 10 are now described. FIG. 16 is an illustration of the transmitter assembly 104 of FIG. 14 as mounted to a wall or ceiling mount bracket 302. In one embodiment, the transmitter assembly 104 is attached to the mounting bracket 304 then attached to a location (e.g., a wall, ceiling, tree, pole, etc.) from which the transmitter assembly 104 is used to simulate a "shoot back" (i.e., long range) scenario, using the 3 mm wavelength laser. In an alternate embodiment, the transmitter assembly 104 can be mounted indoors, on a wall or ceiling, using mounting bracket 304, with the IR laser used to simulate indoor detonation. In still another embodiment, the transmitter assembly 104 can use the wall/ceiling mounting bracket 304 to mount the transmitter assembly 104 to an outdoor location, such as on a tree or a utility pole, to simulate an outdoor IED detonation having an explosion of large magnitude, with a laser range "kill pattern" of approximately 67 m long by 31 m wide by 4 m high. For example, the transmitter assembly 104 can be mounted to a side of a building to project downward this 67 m by 31 m by 4 m pattern.

Figure 17:
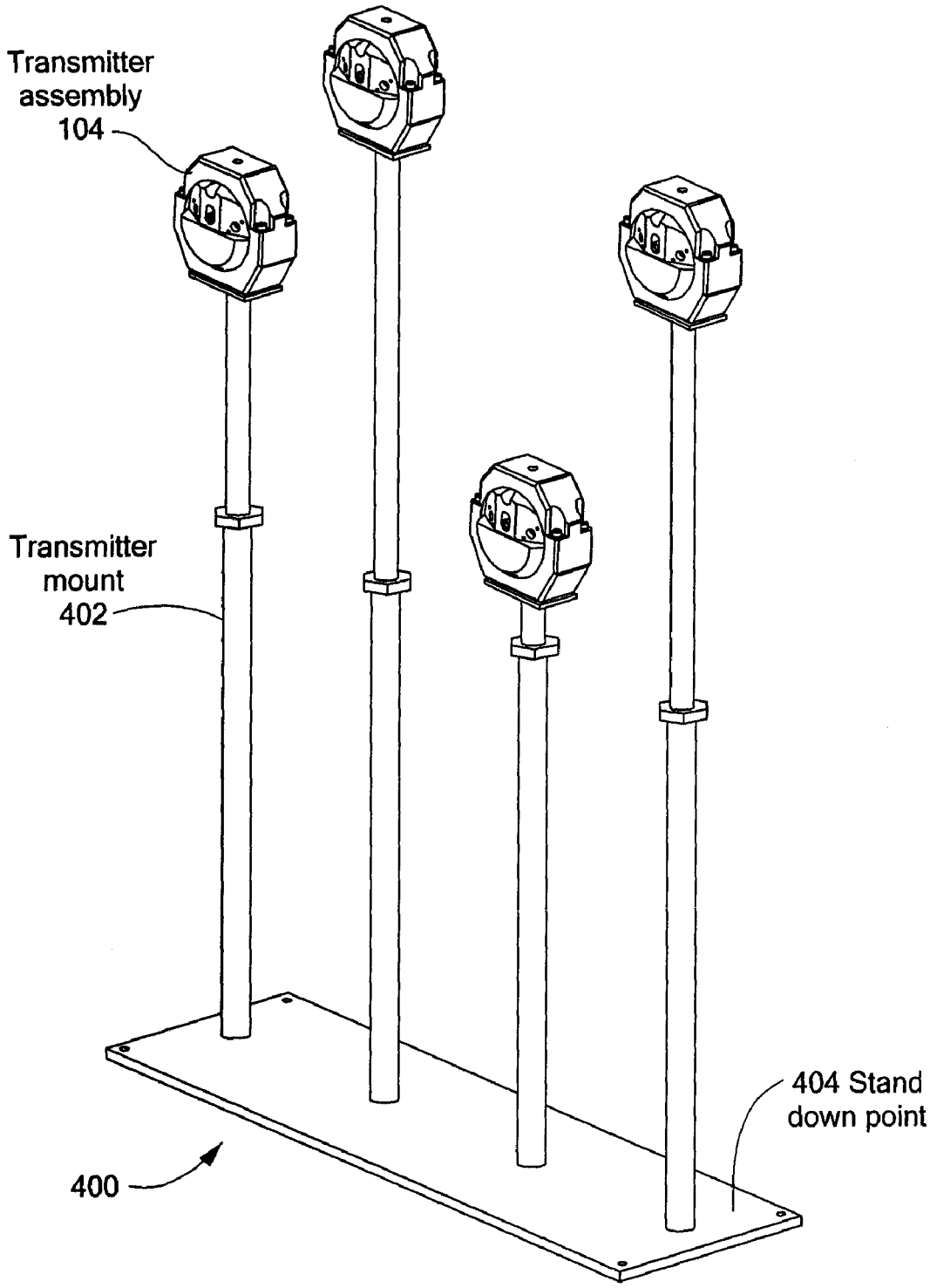
FIG. 17 is an illustration of a configuration of four shoot back transmitters, in accordance with one embodiment of the invention.

FIG. 17 is an illustration of a configuration 400 of four transmitter assemblies 104, in accordance with one embodiment of the invention. Each transmitter assembly 104 is coupled to an elongated transmitter mount 302, which is attached to stand down point 404. In this example, the configuration 400 of transmitters need not be limited to four transmitters; any number is possible. The transmitter assemblies can be positioned away from direct fire (from other MILES devices), if desired. Advantageously, in one embodiment, the transmitter assemblies 104 are all configured to be in long range "shoot back" mode (also referred to as "pop up target" mode), which provides a simulation of a plurality of long range weapons, each having a small cross section of targeted area. This arrangement can simulate, for example, sniper fire by a group of snipers, as well as various other IED operations, such as when a target "pops up", simulating a potential threat and triggering the ILX 12.

In describing the embodiments of the invention illustrated in the figures, specific terminology (e.g., language, phrases, product brands names, etc.) is used for the sake of clarity. These names are provided by way of example only and are not limiting. The invention is not limited to the specific terminology so selected, and each specific term at least includes all grammatical, literal, scientific, technical, and functional equivalents, as well as anything else that operates in a similar manner to accomplish a similar purpose. For example, although particular materials might be described as being used in various embodiments to construct aspects of the IED simulation device, those of skill in the art will recognize that numerous other materials could work equally well. Furthermore, in the illustrations, Figures, and text, specific names may be given to specific features, processes, military programs, etc. Such terminology used herein, however, is for the purpose of description and not limitation.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention.

In the Figures of this application, in some instances, a plurality of system elements may be shown as illustrative of a particular system element, and a single system element or may be shown as illustrative of a plurality of a particular system elements. It should be understood that showing a plurality of a particular element is not intended to imply that a system or method implemented in accordance with the invention must comprise more than one of that element, nor is it intended by illustrating a single element that the invention is limited to embodiments having only a single one of that respective elements. In addition, the total number of elements shown for a particular system element is not intended to be limiting; those skilled in the art can recognize that the number of a particular system element can, in some instances, be selected to accommodate the particular user needs.

In addition, those of ordinary skill in the art will appreciate that the embodiments of the invention described herein can be modified to accommodate and/or comply with changes and improvements in the applicable technology and standards referred to herein. Variations, modifications, and other implementations of what is described herein can occur to those of ordinary skill in the art without departing from the spirit and the scope of the invention as claimed.

The particular combinations of elements and features in the above-detailed embodiments are exemplary only; the interchanging and substitution of these teachings with other teachings in this and the referenced patents/applications are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto.

Having described and illustrated the principles of the technology with reference to specific implementations, it will be recognized that the technology can be implemented in many other, different, forms, and in many different environments. The technology disclosed herein can be used in combination with other technologies. Having described the preferred embodiments of the invention, it will now become apparent to one of ordinary skill in the art that other embodiments incorporating their concepts may be used. These embodiments should not be limited to the disclosed embodiments, but rather should be limited only by the spirit and scope of the appended claims.

The invention claimed is:

1. An improvised explosive device (IED) simulator usable with a laser detector, the IED simulator comprising:

a laser transmitter assembly-constructed and arranged to transmit to a laser detector a laser signal having a substantially three-dimensional (3-D) coverage area of a predetermined size, the predetermined size associated with a corresponding predetermined type of IED explosion, the predetermined size including a distance from target and a cross section, where the laser transmitter assembly comprises:

a ball housing, the ball housing adapted to be operable with a socket, the ball housing having an associated central line and being constructed and arranged to be maneuverable over a predetermined angular range about the central line;

a laser transmitter sub-assembly operably coupled to the ball housing, the laser transmitter sub-assembly configured to generate the laser signal, wherein the laser transmitter sub-assembly is oriented within the ball housing portion such that movement of the ball housing portion within its predetermined angular range varies a width of the cross-section of the laser signal;

a first switch operably coupled to the laser transmitter assembly, the first switch permitting a user to trigger the laser signal from the laser transmitter assembly; and a second switch operably coupled to the laser transmitter assembly, the second switch permitting the user to select the predetermined type of IED explosion to be simulated, wherein the predetermined type of IED explosion is selected from a plurality of different types of IED explosions and wherein the laser transmitter assembly varies the 3-D coverage area of the laser signal based on the selected type of IED explosion to be simulated.

2. The IED simulator of claim 1, wherein the predetermined type of explosion that is simulated comprises a first IED explosion having a corresponding first 3-D coverage that comprises a corresponding first laser signal that is approximately 2 meters (m) to 5 m distance from a target, with a circular cross-section having a diameter of approximately 2 feet (ft).

3. The IED simulator of claim 1, wherein the predetermined type of explosion that is simulated comprises a second IED explosion having a corresponding second 3-D coverage that comprises a corresponding second laser signal that is approximately 20 m to 600 m distance from a target, with a rectangular cross-section of approximately 3 ft. wide and 4 ft. high.

4. The IED simulator of claim 1, wherein the predetermined type of explosion that is simulated comprises a third IED explosion having a corresponding third 3-D coverage in the form of a corresponding third enveloped laser pattern of approximately 67 m long by 31 m wide by 4 m high, the corresponding third enveloped laser pattern resulting in corresponding third 3-D coverage of approximately 67 m distance to target and a rectangular cross-section that is approximately 31 m wide by 4 m high.

5. The IED simulator of claim 4, wherein movement of the ball housing portion within its predetermined angular range increases the width of the cross-section of the corresponding third enveloped laser signal from approximately 31 m wide to approximately 44 m wide.

6. The IED simulator of claim 1, further comprising a third switch operably coupled to the ball housing and a physical effect simulator operably coupled to and responsive to triggering of the third switch, the physical effect simulator producing at least one physical effect that simulates the explosion of an IED.

7. The IED simulator of claim 6, wherein the physical effect simulator comprises at least one of an anti-tank weapons effect systems simulator (ATWESS) and a pyrotechnic device.

8. The IED simulator of claim 6, wherein the third switch is operably coupled to the laser transmitter sub-assembly, such that triggering the third switch triggers generation of both the laser signal and a physical effect substantially simultaneously.

9. The IED simulator of claim 1, further comprising a controller in operable communication with the laser transmitter assembly and the first switch, the controller operable to:

respond to triggering of the first switch; and direct the laser transmitter sub-assembly to generate and transmit the laser signal, wherein the controller selects the type of an IED explosion to simulate based on at least one of:

the setting of the second switch, wherein the second switch selects the type of IED explosion to be generated; and a control signal received at the controller, the control signal directing the controller to simulate a type of IED explosion.

10. The IED simulator of claim 9, wherein the control signal is provided by at least one of the following:

a computing device;

a remote trigger device constructed and arranged to permit a user to remotely trigger the laser transmitter;

a receiver in operable communication with the third switch, the third switch directing the controller to simulate a type of IED explosion; and a receiver in operable communication with a wireless remote trigger device, the receiver capable of receiving a radio frequency (RF) signal from the wireless remote trigger device, the wireless remote trigger device permitting a user to remotely trigger the laser transmitter sub-assembly.

11. The IED simulator of claim 1, further comprising a display constructed and arranged to display information related to operation of the IED simulator to an operator of the IED simulator, the information related to operation of the IED comprises at least one piece of information selected from the group consisting of round count, player identification number, laser power level, rounds remaining, weapon type, and battery level.

12. The IED simulator of claim 1, wherein the laser transmitter assembly is constructed and arranged to generate a laser signal encoded with a MILES code.

13. The IED simulator of claim 1, wherein the laser transmitter assembly is constructed and arranged to generate an alignment laser signal.

14. The IED simulator of claim 2, wherein the laser transmitter sub-assembly comprises a first infrared (IR) laser transmitter operably coupled to the ball housing, the first IR laser transmitter constructed and arranged to generate a first laser signal having the first 3-D coverage.

15. The IED simulator of claim 3, wherein the laser transmitter sub-assembly comprises a second 3 mm laser transmitter operably coupled to the ball housing, the second 3 mm laser transmitter constructed and arranged to generate the second laser signal having the second 3-D coverage.

16. The IED simulator of claim 4, wherein the laser transmitter sub-assembly comprises corresponding third and fourth 6 mm laser transmitters operably coupled to the ball housing, each of the third and fourth laser transmitters cooperating to generate the corresponding third enveloped laser pattern.

17. The IED simulator of claim 1, wherein the predetermined type of explosion that is simulated is selected from:

a first IED explosion having a corresponding first 3-D coverage that comprises a corresponding first laser signal that is approximately 2 meters (m) to 5 m distance from a target, with a circular cross-section having a diameter of approximately 2 feet (ft);

a second IED explosion having a corresponding second 3-D coverage that comprises a corresponding second laser signal that is approximately 20 m to 600 m distance from a target, with a rectangular cross-section of approximately 3 ft. wide and 4 ft. high; and a third IED explosion having a corresponding third 3-D coverage in the form of a corresponding third enveloped laser pattern of approximately 67 m long by 31 m wide by 4 m high, the corresponding third enveloped laser pattern resulting in corresponding third 3-D coverage of approximately 67 m distance to target and a rectangular cross-section that is approximately 31 m wide by 4 m high.

18. The IED simulator of claim 17, wherein the laser transmitter sub-assembly further comprises:

an alignment laser transmitter disposed within the ball housing, the alignment laser transmitter constructed and arranged to generate an alignment laser signal, wherein the ball housing includes an opening enabling the laser alignment signal to be transmitted;

a first infrared (IR) laser transmitter disposed within the ball housing, the first IR laser transmitter constructed and arranged to generate a first laser signal having the first 3-D coverage and transmit the first laser signal through the opening;

a second 3 mm laser transmitter operably disposed within the ball housing, the second 3 mm laser transmitter constructed and arranged to generate the second laser signal having the second 3-D coverage and transmit the second laser signal through the opening; and third and fourth 6 mm laser transmitters operably coupled to the ball housing, each of the third and fourth laser transmitters cooperating to generate the corresponding third enveloped laser pattern, wherein the third and fourth transmitters are positioned on the ball housing such that movement of the ball housing portion within its predetermined angular range increases the width of the cross-section of the corresponding third enveloped laser signal from approximately 31 m wide to approximately 44 m wide.

19. The IED simulator of claim 1, further comprising a multi-laser housing operably coupled to the opening of ball housing, wherein the alignment laser transmitter, first laser transmitter, and second laser transmitter are operably coupled to and held in a predetermined orientation by the multi-laser housing.

20. A system usable with a detector responsive to a laser signal for simulating the operation of an improvised explosive device (IED), the system comprising:

means for enabling a user to select the type of IED explosion to be simulated, wherein the type of IED explosion is selected from a plurality of different types of IED explosions;

means for enabling a user to trigger a simulated explosion of an IED;

a laser transmitter assembly-constructed and arranged to transmit to a laser detector a laser signal having a substantially three-dimensional (3-D) coverage area of a predetermined size, the predetermined size associated with a corresponding predetermined type of IED explosion, the predetermined size including a distance from target and a cross section, where the laser transmitter assembly comprises:

a ball housing, the ball housing adapted to be operable with a socket, the ball housing having an associated central line and being constructed and arranged to be maneuverable over a predetermined angular range about the central line;

a laser transmitter sub-assembly operably coupled to the ball housing, the laser transmitter sub-assembly configured to generate the laser signal, wherein the laser transmitter sub-assembly is oriented within the ball housing portion such that movement of the ball housing portion within its predetermined angular range varies a width of the cross-section of the laser signal.

21. The system of claim 20, further comprising means for generating a 3-D laser signal simulating a first IED explosion having a corresponding first 3-D coverage that comprises a corresponding first laser signal that is approximately 2 meters (m) to 5 m distance from a target, with a circular cross-section having a diameter of approximately 2 feet (ft).

22. The system of claim 20, further comprising means for generating a 3-D laser signal simulating a second IED explosion having a corresponding second 3-D coverage that comprises a corresponding second laser signal that is approximately 20 m to 600 m distance from a target, with a rectangular cross-section of approximately 3 ft. wide and 4 ft. high.

23. The system of claim 20, further comprising means for generating a 3-D laser signal simulating a third IED explosion having a corresponding third 3-D coverage in the form of a corresponding third enveloped laser pattern of approximately 67 m long by 31 m wide by 4 m high, the corresponding third enveloped laser pattern resulting in corresponding third 3-D coverage of approximately 67 m distance to target and a rectangular cross-section that is approximately 31 m wide by 4 m high.

24. The system of claim 20, further comprising means for generating a plurality of 3-D laser signals simulating a corresponding plurality of types of IED explosions, wherein the plurality of types of IED explosions include at least:

a first IED explosion having a corresponding first 3-D coverage that comprises a corresponding first laser signal that is approximately 2 meters (m) to 5 m distance from a target, with a circular cross-section having a diameter of approximately 2 feet (ft);

a second IED explosion having a corresponding second 3-D coverage that comprises a corresponding second laser signal that is approximately 20 m to 600 m distance from a target, with a rectangular cross-section of approximately 3 ft. wide and 4 ft. high; and a third IED explosion having a corresponding third 3-D coverage in the form of a corresponding third enveloped laser pattern of approximately 67 m long by 31 m wide by 4 m high, the corresponding third enveloped laser pattern resulting in corresponding third 3-D coverage of approximately 67 m distance to target and a rectangular cross-section that is approximately 31 m wide by 4 m high.

25. The system of claim 20, further comprising user-controllable means for generating a physical indicator simulating the IED explosion.

* * * * *